US007562018B2

(12) United States Patent
Kamai et al.

(10) Patent No.: US 7,562,018 B2
(45) Date of Patent: Jul. 14, 2009

(54) SPEECH SYNTHESIS METHOD AND SPEECH SYNTHESIZER

(75) Inventors: Takahiro Kamai, Kyoto (JP); Yumiko Kato, Osaka (JP)

(73) Assignee: Panasonic Corporation, Osaka (JP)

( * ) Notice: Subject to any disclaimer, the term of this patent is extended or adjusted under 35 U.S.C. 154(b) by 603 days.

(21) Appl. No.: 10/506,203

(22) PCT Filed: Nov. 25, 2003

(86) PCT No.: PCT/JP03/14961

§ 371 (c)(1),
(2), (4) Date: Aug. 31, 2004

(87) PCT Pub. No.: WO2004/049304

PCT Pub. Date: Jun. 10, 2004

(65) Prior Publication Data

US 2005/0125227 A1 Jun. 9, 2005

(30) Foreign Application Priority Data

Nov. 25, 2002 (JP) ..... 2002-341274

(51) Int. Cl.
*G10L 13/06* (2006.01)

(52) U.S. Cl. ..... 704/268; 704/269; 704/258

(58) Field of Classification Search ..... 704/207, 704/205, 268, 278, 218, 206, 203, 209, 258
See application file for complete search history.

(56) References Cited

U.S. PATENT DOCUMENTS 5,933,808 A * 8/1999 Kang et al. ..... 704/278
6,112,169 A * 8/2000 Dolson ..... 704/205
6,115,684 A 9/2000 Kawahara et al.
6,349,277 B1 * 2/2002 Kamai et al. ..... 704/207

FOREIGN PATENT DOCUMENTS

JP 53-143102 12/1978
JP 54-133119 A 10/1979

(Continued)

OTHER PUBLICATIONS

International Search Report for PCT/JP03/14961, mailed Jan. 20, 2004, ISA/JPO.

(Continued)

*Primary Examiner*—Huyen X. Vo
(74) *Attorney, Agent, or Firm*—Harness, Dickey & Pierce, P.L.C.

(57) ABSTRACT

A language processing portion (31) analyzes a text from a dialogue processing section (20) and transforms the text to information on pronunciation and accent. A prosody generation portion (32) generates an intonation pattern according to a control signal from the dialogue processing section (20). A waveform DB (34) stores prerecorded waveform data together with pitch mark data imparted thereto. A waveform cutting portion (33) cuts desired pitch waveforms from the waveform DB (34). A phase operation portion (35) removes phase fluctuation by standardizing phase spectra of the pitch waveforms cut by the waveform cutting portion (33), and afterwards imparts phase fluctuation by diffusing only high phase components randomly according to the control signal from the dialogue processing section (20). The thus-produced pitch waveforms are placed at desired intervals and superimposed.

10 Claims, 29 Drawing Sheets

FOREIGN PATENT DOCUMENTS

| | | | |
|---|---|---|---|
| JP | 58-168097 | | 10/1983 |
| JP | 4-21900 | A | 1/1992 |
| JP | 5-265486 | A | 10/1993 |
| JP | 10-232699 | A | 9/1998 |
| JP | 10-319995 | A | 12/1998 |
| JP | 11-102199 | A | 4/1999 |
| JP | 11-184497 | A | 7/1999 |
| JP | 2000-194388 | A | 7/2000 |
| JP | 2001-117600 | A | 4/2001 |
| JP | 2001-184098 | A | 7/2001 |

OTHER PUBLICATIONS

Kawahara, Hideki. "Restructuring Speech Representations Using a Pitch-Adaptive Time-Frequency Smoothing and an Instantaneous-Frequency-Based F0 Extraction: Possible Role of a Repetitive Structure in Sounds," Speech Communication 27 (1999), Elsevier Science B.V., pp. 187-207, Tokyo, Japan.

Kawahara, Hideki. "Speech Representation and Transformation Using Adaptive Interpolation of Weighted Spectrum: Vocoder Revisited," (1997) IEEE, pp. 1303-1306, Kyoto, Japan.

* cited by examiner

FIG. 7A Original speech

FIG. 7B Without fluctuation

FIG. 7C With fluctuation

With fluctuation

Without fluctuation

FIG. 10

| Type of feelings | Imparting timing | $\omega_k$ (Hz) (Note 1) |
|---|---|---|
| Weak joy | Text head | 4500 |
| Intermediate joy | Text head | 4000 |
| Intense joy | Text head | 3500 |
| Weak apology | Text head + end | 4000 |
| Intermediate apology | Text head + end | 3500 |
| Intense apology | Text head + end | 3000 |
| Weak familiarity | Entire text | 4000 |
| Intermediate familiarity | Entire text | 3000 |
| Intense familiarity | Entire text | 2500 |

Note 1: $\omega_k$ is a frequency corresponding to k in Expression 5.
The amount of fluctuation component is larger as this frequency is lower.

Example of expressing intense apology

Another implementation example of phase fluctuation imparting portion 355

SPEECH SYNTHESIS METHOD AND SPEECH SYNTHESIZER

TECHNICAL FIELD

The present invention relates to a method and apparatus for producing speech artificially.

BACKGROUND ART

In recent years, digital technology-applied information equipment has increasingly enhanced in function and complicated at a rapid pace. As one of user interfaces for facilitating easy access of the user to such digital information equipment, a speech interactive interface is known. The speech interactive interface executes exchange of information (interaction) with the user by voice, to achieve desired manipulation of the equipment. This type of interface has started to be mounted in car navigation systems, digital TV sets and the like.

The interaction achieved by the speech interactive interface is an interaction between the user (human) having feelings and the system (machine) having no feelings. Therefore, if the system responds with monotonous synthesized speech in any situation, the user will feel strange or uncomfortable. To make the speech interactive interface comfortable in use, the system must respond with natural synthesized speech that will not make the user feel strange or uncomfortable. To attain this, it is necessary to produce synthesized speech tinted with feelings suitable for individual situations.

As of today, among studies on speech-mediated expression of feelings, those focusing on pitch change patterns are in the mainstream. In this relation, many studies have been made on intonation expressing feelings of joy and anger. In many of the studies, examined is how people feel when a text is spoken in various pitch patterns as shown in FIG. 29 (in the illustrated example, the text is "ohayai okaeri desune (you are leaving early today, aren't you?)".

DISCLOSURE OF THE INVENTION

An object of the present invention is providing a speech synthesis method and a speech synthesizer capable of improving the naturalness of synthesized speech.

The speech synthesis method of the present invention includes steps (a) to (c). In the step (a), a first fluctuation component is removed from a speech waveform containing the first fluctuation component. In the step (b), a second fluctuation component is imparted to the speech waveform obtained by removing the first fluctuation component in the step (a). In the step (c), synthesized speech is produced using the speech waveform obtained by imparting the second fluctuation component in the step (b).

Preferably, the first and second fluctuation components are phase fluctuations.

Preferably, in the step (b), the second fluctuation component is imparted at timing and/or weighting according to feelings to be expressed in the synthesized speech produced in the step (c).

The speech synthesizer of the present invention includes means (a) to (c). The means (a) removes a first fluctuation component from a speech waveform containing the first fluctuation component. The means (b) imparts a second fluctuation component to the speech waveform obtained by removing the first fluctuation component by the means (a). The means (c) produces synthesized speech using the speech waveform obtained by imparting the second fluctuation component by the means (b).

Preferably, the first and second fluctuation components are phase fluctuations.

Preferably, the speech synthesizer further includes a means (d) of controlling timing and/or weighting at which the second fluctuation component is imparted.

In the speech synthesis method and the speech synthesizer described above, whispering speech can be effectively attained by imparting the second fluctuation component to the speech, and this improves the naturalness of synthesized speech.

The second fluctuation component is imparted newly after removal of the first fluctuation component contained in the speech waveform. Therefore, roughness that may be generated when the pitch of synthesized speech is changed can be suppressed, and thus generation of buzzer-like sound in the synthesized speech can be reduced.

BRIEF DESCRIPTION OF THE DRAWINGS

FIG. 10 is a view showing an example of the correlation between the type of feelings given to synthesized speech and the timing and frequency domain at which fluctuation is imparted.

FIG. 14(*b*) is a block diagram showing an example of implementation of a phase fluctuation imparting portion.

FIG. 17(*b*) is a block diagram showing an internal configuration of a phase fluctuation removal portion shown in FIG. 17(*a*).

FIG. 18(*b*) is a block diagram showing a configuration of a device for producing representative pitch waveforms to be stored in a representative pitch waveform DB.

FIG. 20(*b*) is a block diagram showing a configuration of a device for producing representative pitch waveforms to be stored in a representative pitch waveform DB.

FIG. 29(*b*) is a view showing a pitch pattern changed so as to sound sarcastic.

BEST MODE FOR CARRYING OUT THE INVENTION

Figure 1:
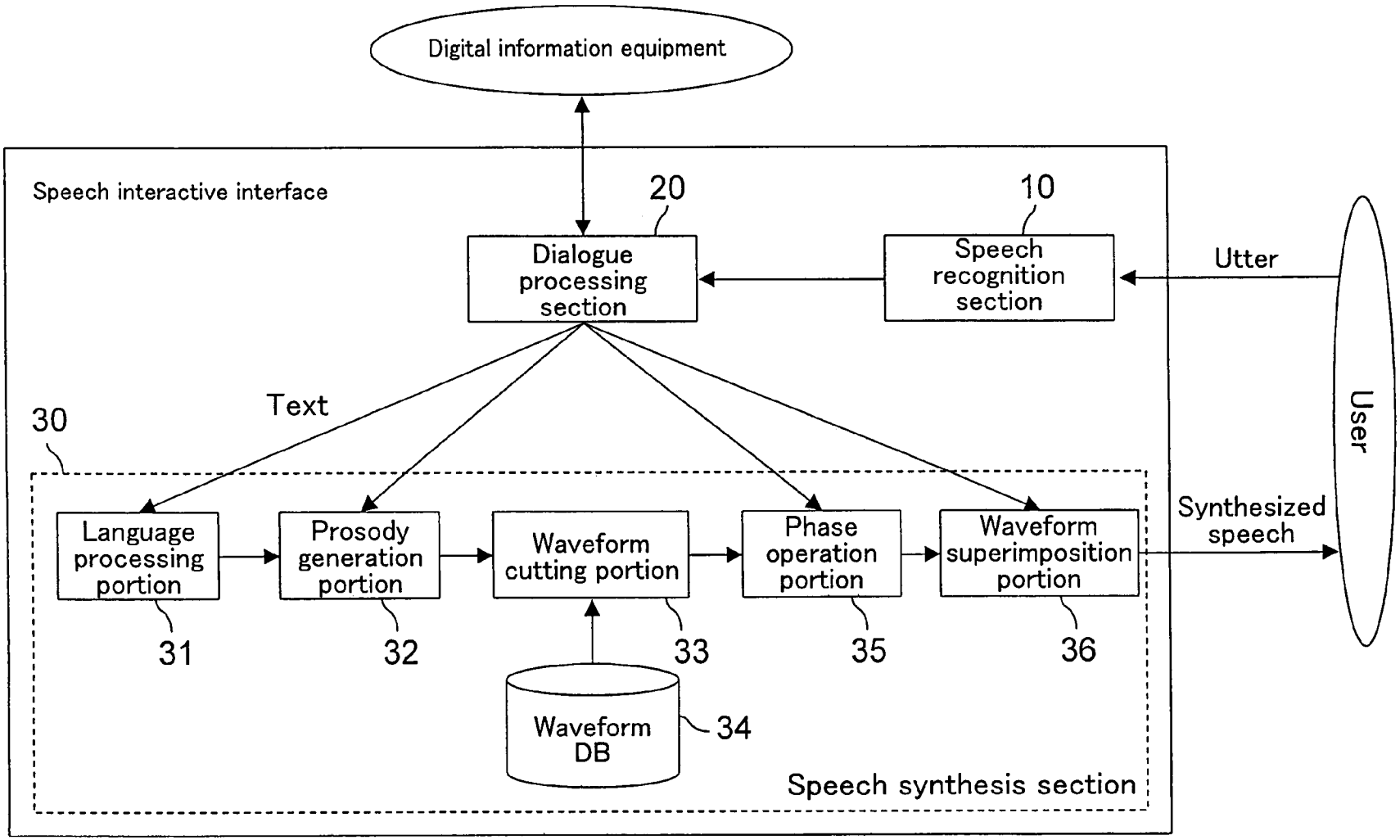
FIG. 1 is a block diagram showing a configuration of a speech interactive interface in Embodiment 1.

Hereinafter, embodiments of the present invention will be described in detail with reference to the relevant drawings. Note that the same or equivalent components are denoted by the same reference numerals, and the description of such components is not repeated.

Embodiment 1

Configuration of Speech Interactive Interface

FIG. 1 shows a configuration of a speech interactive interface in Embodiment 1. The interface, which is placed between digit information equipment (such as a digital TV set and a car navigation system, for example) and the user, executes exchange of information (interaction) with the user, to assist the manipulation of the equipment by the user. The interface includes a speech recognition section 10, a dialogue processing section 20 and a speech synthesis section 30.

The speech recognition section 10 recognizes speech uttered by the user.

The dialogue processing section 20 sends a control signal according to the results of the recognition by the speech recognition section 10 to the digital information equipment. The dialogue processing section 20 also sends a response (text) according to the results of the recognition by the speech recognition section 10 and/or a control signal received from the digital information equipment, together with a signal for controlling feelings given to the response text, to the speech synthesis section 30.

The speech synthesis section 30 produces synthesized speech by a rule synthesis method based on the text and the signal received from the dialogue processing section 20. The speech synthesis section 30 includes a language processing portion 31, a prosody generation portion 32, a waveform cutting portion 33, a waveform database (DB) 34, a phase operation portion 35 and a waveform superimposition portion 36.

The language processing portion 31 analyzes the text from the dialogue processing section 20 and transforms the text to information on pronunciation and accent.

The prosody generation portion 32 generates an intonation pattern according to the control signal from the dialogue processing section 20.

Figure 2:
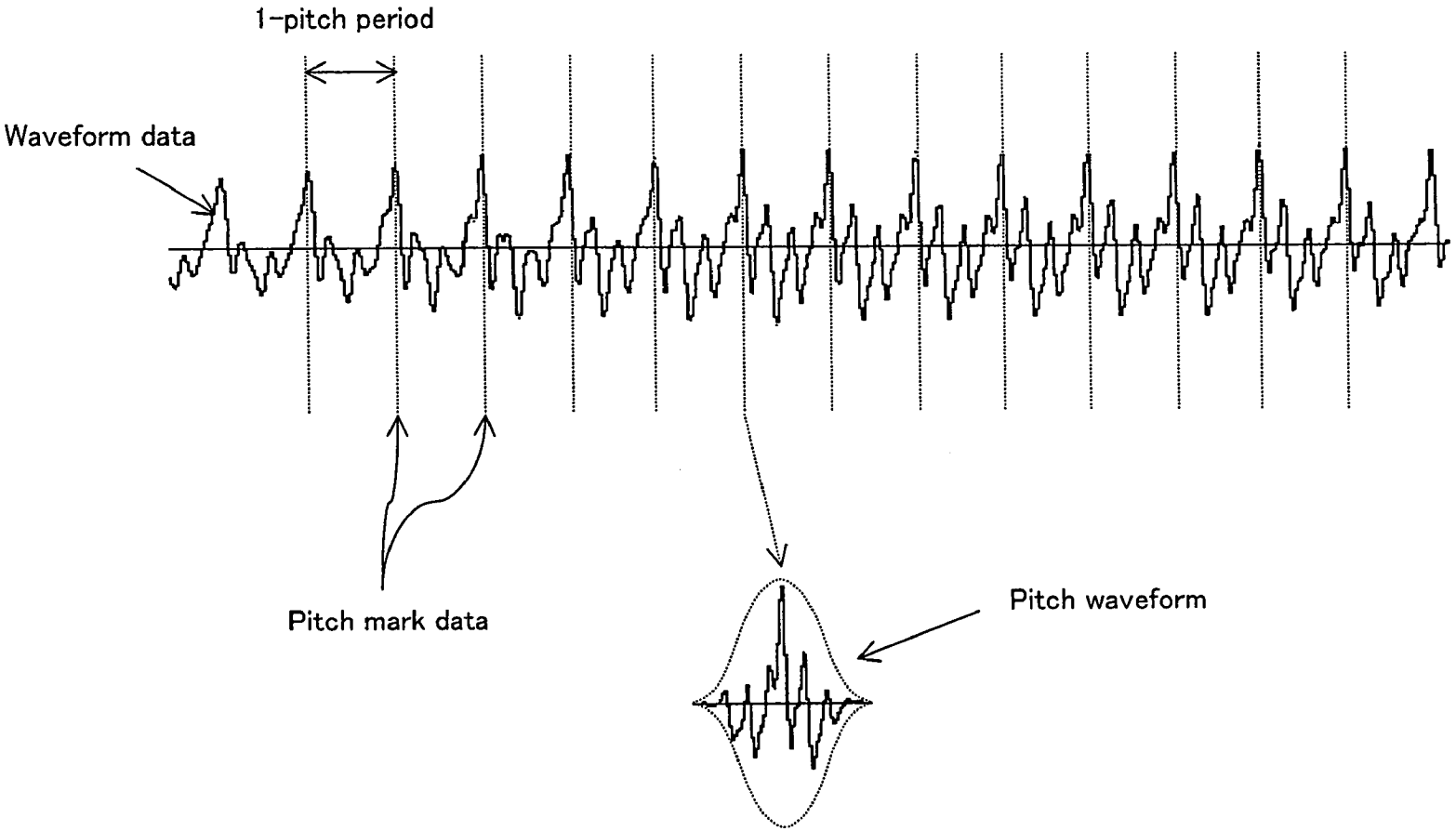
FIG. 2 is a view showing speech waveform data, pitch marks and a pitch waveform.

In the waveform DB 34, stored are prerecorded waveform data together with data of pitch marks given to the waveform data. FIG. 2 shows an example of such a waveform and pitch marks.

The waveform cutting portion 33 cuts desired pitch waveforms from the waveform DB 34. The cutting is typically made using Hanning window function (function that has a gain of 1 in the center and smoothly converges to near 0 toward both ends). FIG. 2 shows how the cutting is made.

The phase operation portion 35 standardizes the phase spectrum of a pitch waveform cut by the waveform cutting portion 33, and then diffuses only a high phase component randomly according to the control signal from the dialogue processing section 20 to thereby impart phase fluctuation. Hereinafter, the operation of the phase operation portion 35 will be described in detail.

First, the phase operation portion 35 performs discrete Fourier transform (DFT) for a pitch waveform received from the waveform cutting section 33 to transform the waveform to a frequency-domain signal. The input pitch waveform is represented as vector $\vec{s}_i$ by Expression 1:

$$\vec{s}_i=[s_i(0)s_i(1)\ldots s_i(N-1)] \qquad \text{Expression 1}$$

where the subscript i denotes the number of the pitch waveform, and Si(n) denotes the n-th sample value from the head of the pitch waveform. This is transformed to frequency-domain vector $\vec{S}_i$ by DFT, which is expressed by Expression 2.

$$\vec{S}_i=[S_i(0)\ldots S_i(N/2-1)S_i(N/2)\ldots S_i(N-1)] \qquad \text{Expression 2}$$

where Si(0) to Si(N/2−1) represent positive frequency components, and Si(N/2) to Si(N−1) represent negative frequency components. Si(0) represents 0 Hz or a DC component. The frequency components Si(k) are complex numbers, and therefore can be represented by Expression 3:

$$S_i(k) = |S_i(k)|e^{j\theta(i,k)}, \qquad \text{Expression 3}$$

$$|S_i(k)| = \sqrt{x_i^2(k) + y_i^2(k)},$$

-continued $$\theta(i,k) = \arg Si(k) = \arctan\frac{y_i(k)}{x_i(k)},$$

$$x_i(k) = \mathrm{Re}(Si(k)),\ y_i(k) = \mathrm{Im}(Si(k))$$

where Re(c) represents the real part of a complex number c and Im(c) represents the imaginary part thereof. The phase operation portion 35 transforms $S_i(k)$ in Expression 3 to $\hat{S}_i(k)$ by Expression 4 as the former part of its processing.

$$\hat{S}_i(k)=|S_i(k)|e^{j\rho(k)} \qquad \text{Expression 4}$$

where ρ(k) is a phase spectrum value for the frequency k, serving as a function of only k independent of the pitch number i. That is, the same value is used as ρ(k) for all pitch waveforms. Therefore, the phase spectra of all pitch waveforms are the same, and in this way, phase fluctuation is removed. Typically, ρ(k) may be constant 0. This completely removes the phase components.

The phase operation portion 35 then determines a proper boundary frequency $\omega_k$ according to the control signal from the dialogue processing section 20, and imparts phase fluctuation to a frequency component higher than $\omega_k$, as the latter part of its processing. For example, phase diffusion is made by randomizing phase components as in Expression $$\text{Expression 5}$$

$$`S_i(h) = \hat{S}_i(h)\Phi,$$

$$`S_i(M-h) = `S_i(M-h)\bar{\Phi},$$

$$\Phi = \begin{cases} e^{j\phi}, & \text{if } h > k \\ 1, & \text{if } h \le k \end{cases}$$

where Φ is a random value, k is the number of the frequency component corresponding to the boundary frequency $\omega_k$.

Vector $`\vec{S}_i$ composed of the thus-obtained values $`\vec{S}_i(h)$ is defined as Expression 6.

$$\vec{S}_i=[S_i(0)\ldots S_i(N/2-1)S_i(N/2)\ldots S_i(N-1)] \qquad \text{Expression 6}$$

This $`\vec{S}_i$ is transformed to a time-domain signal by inverse discrete Fourier transform (IDFT), to obtain $`\vec{s}_i$ of Expression 7:

$$\vec{s}_i=[s_i(0)s_i(1)\ldots s_i(N-1)] \qquad \text{Expression 7}$$

Figure 3:
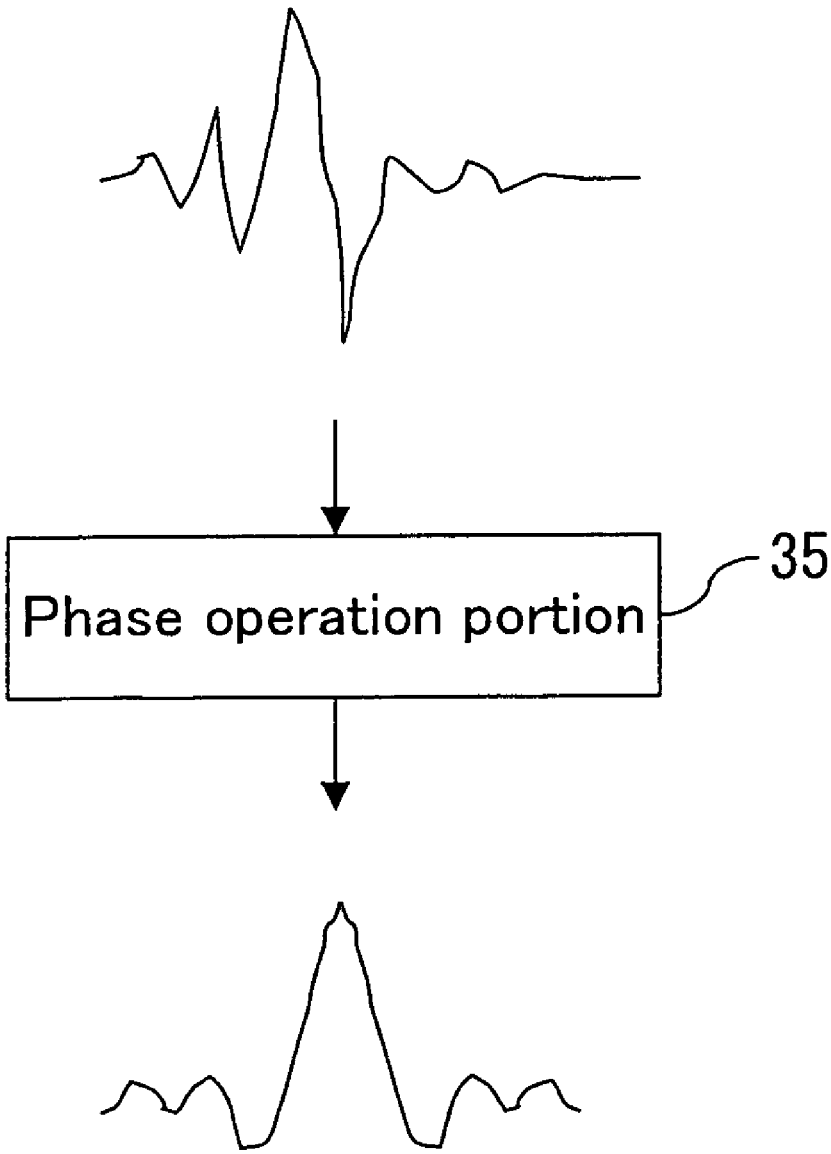
FIG. 3 is a view showing how a pitch waveform is changed to a quasi-symmetric waveform.

This $`\vec{s}_i$ is a phase-operated pitch waveform in which the phase has been standardized and then phase fluctuation has been imparted to only a high frequency. When ρ(k) in Expression 4 is constant 0, $`\vec{s}_i$ is a quasi-symmetric waveform. This is shown in FIG. 3.

Figure 4:
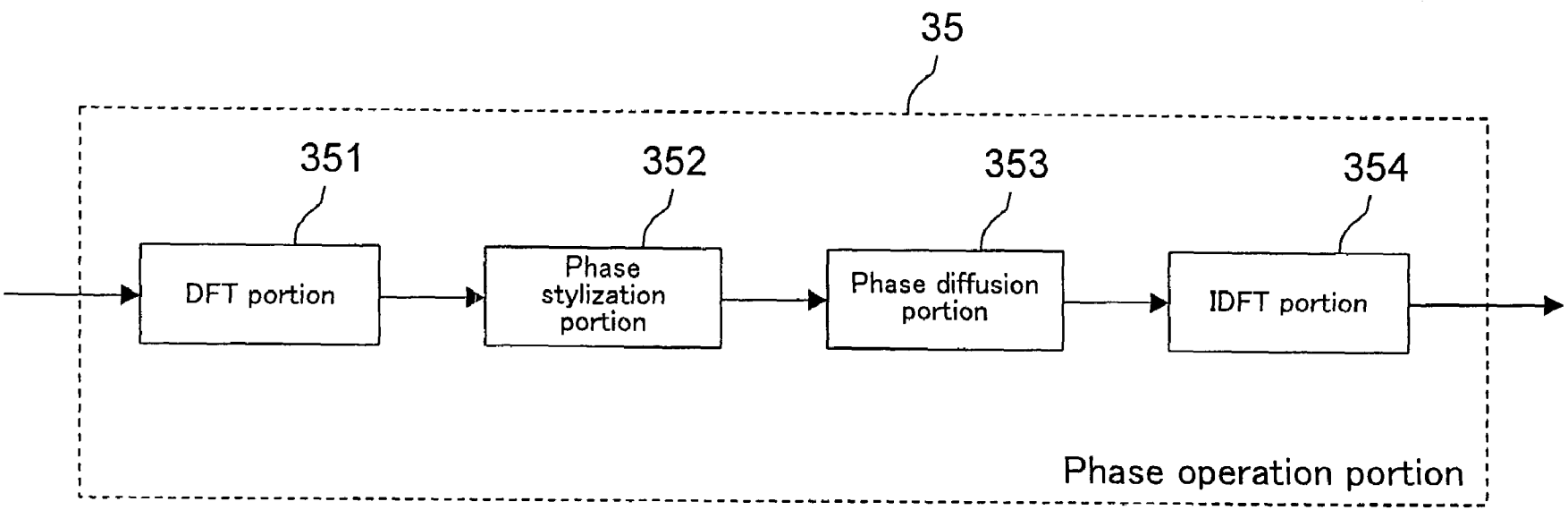
FIG. 4 is a block diagram showing an internal configuration of a phase operation portion.

FIG. 4 shows an internal configuration of the phase operation portion 35. Referring to FIG. 4, the output of a DFT portion 351 is connected to a phase stylization portion 352, the output of the phase stylization portion 352 is connected to a phase diffusion portion 353, and the output of the phase diffusion portion 353 is connected to an IDFT portion 354. The DFT portion 351 executes the transform from Expression 1 to Expression 2, the phase stylization portion 352 executes the transform from Expression 3 to Expression 4, the phase diffusion portion 353 executes the transform of Expression 5, and the IDFT portion 354 executes the transform from Expression 6 to Expression 7.

The thus-obtained phase-operated pitch waveforms are placed at predetermined intervals and superimposed. Amplitude adjustment may also be made to provide desired amplitude.

Figure 5:
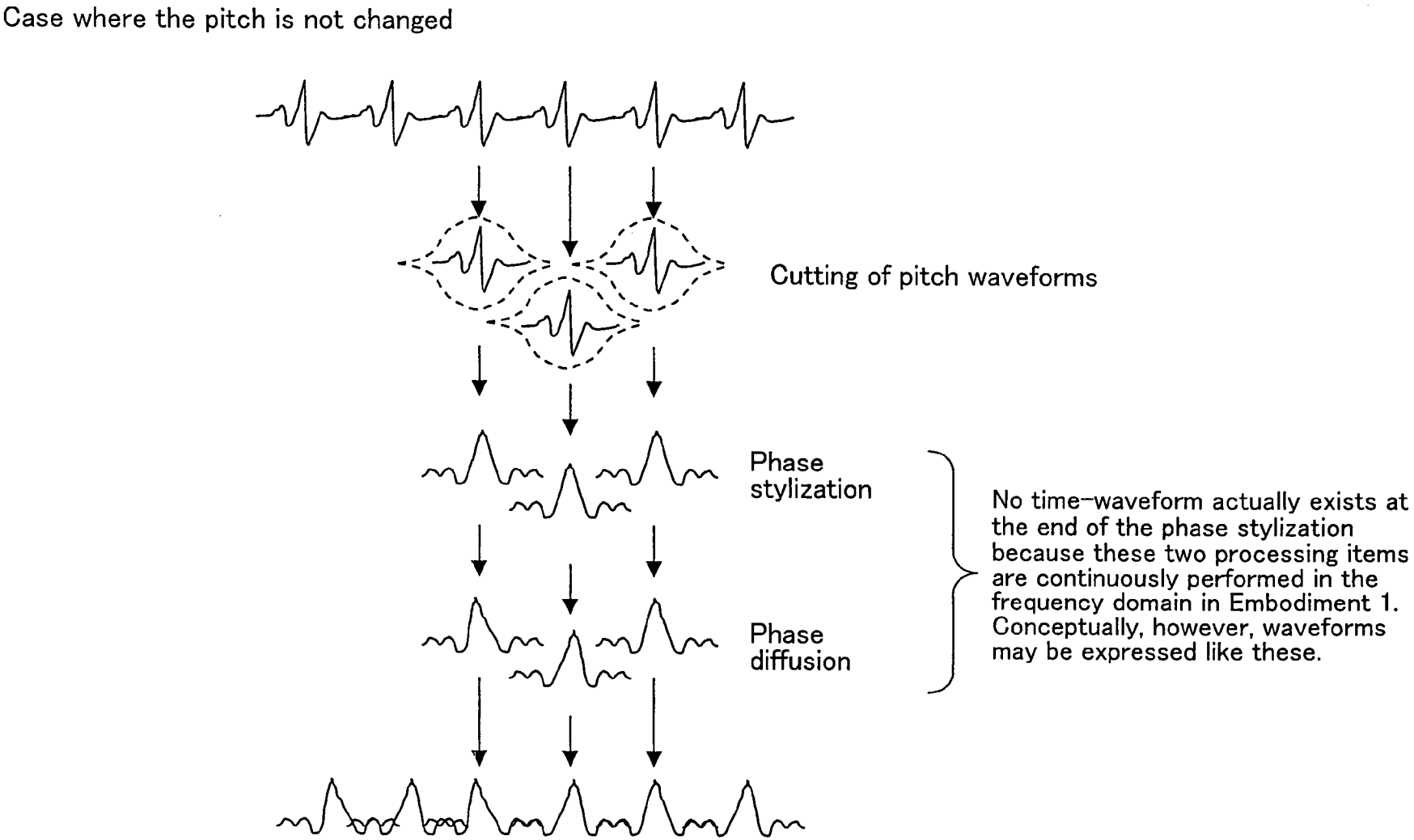
FIG. 5 is a view showing a series of processing from cutting of pitch waveforms to superimposition of phase-operated pitch waveforms to obtain synthesis speech.
Figure 6:
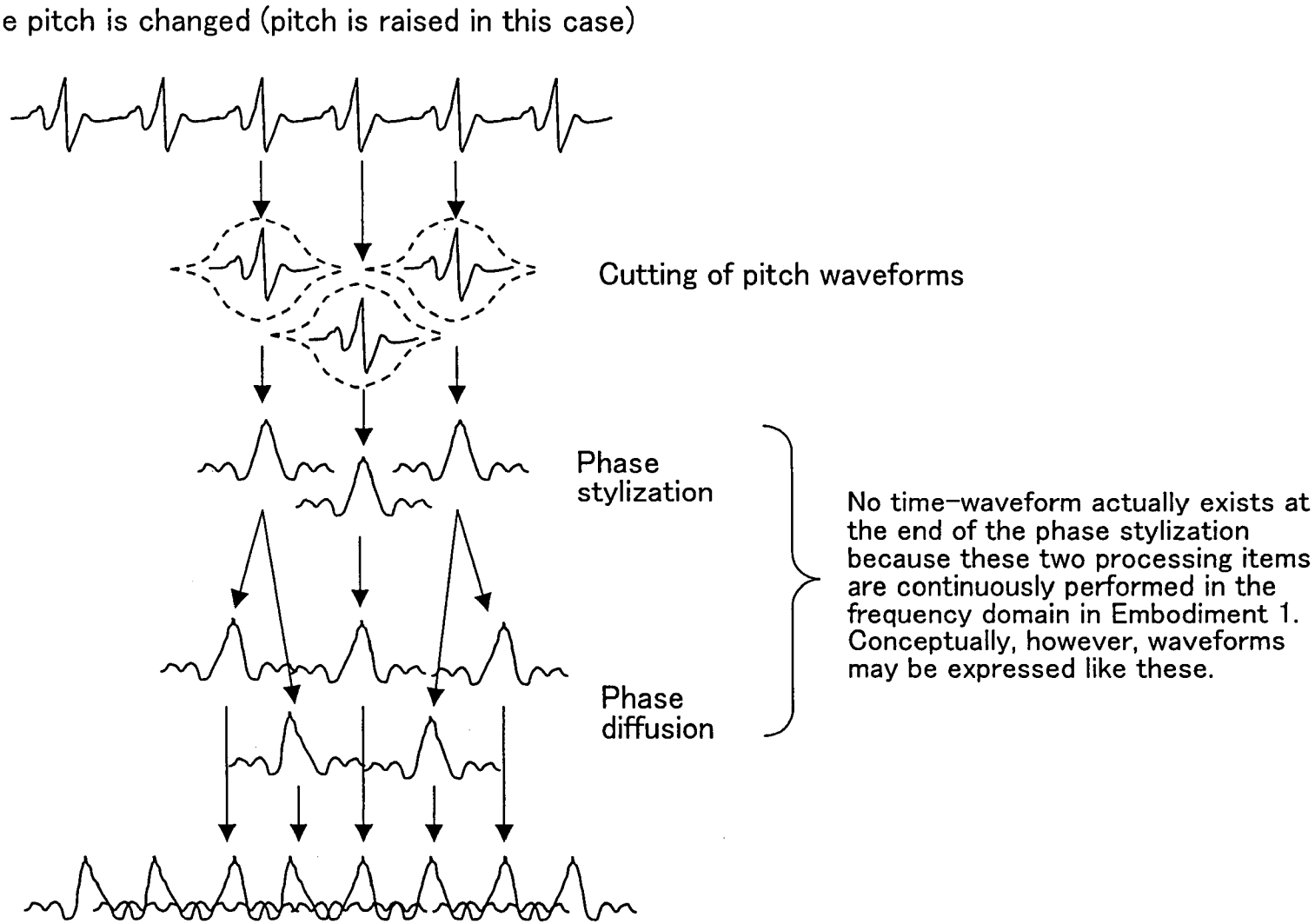
FIG. 6 is another view showing a series of processing from cutting of pitch waveforms to superimposition of phase-operated pitch waveforms to obtain synthesis speech.
Figure 7:
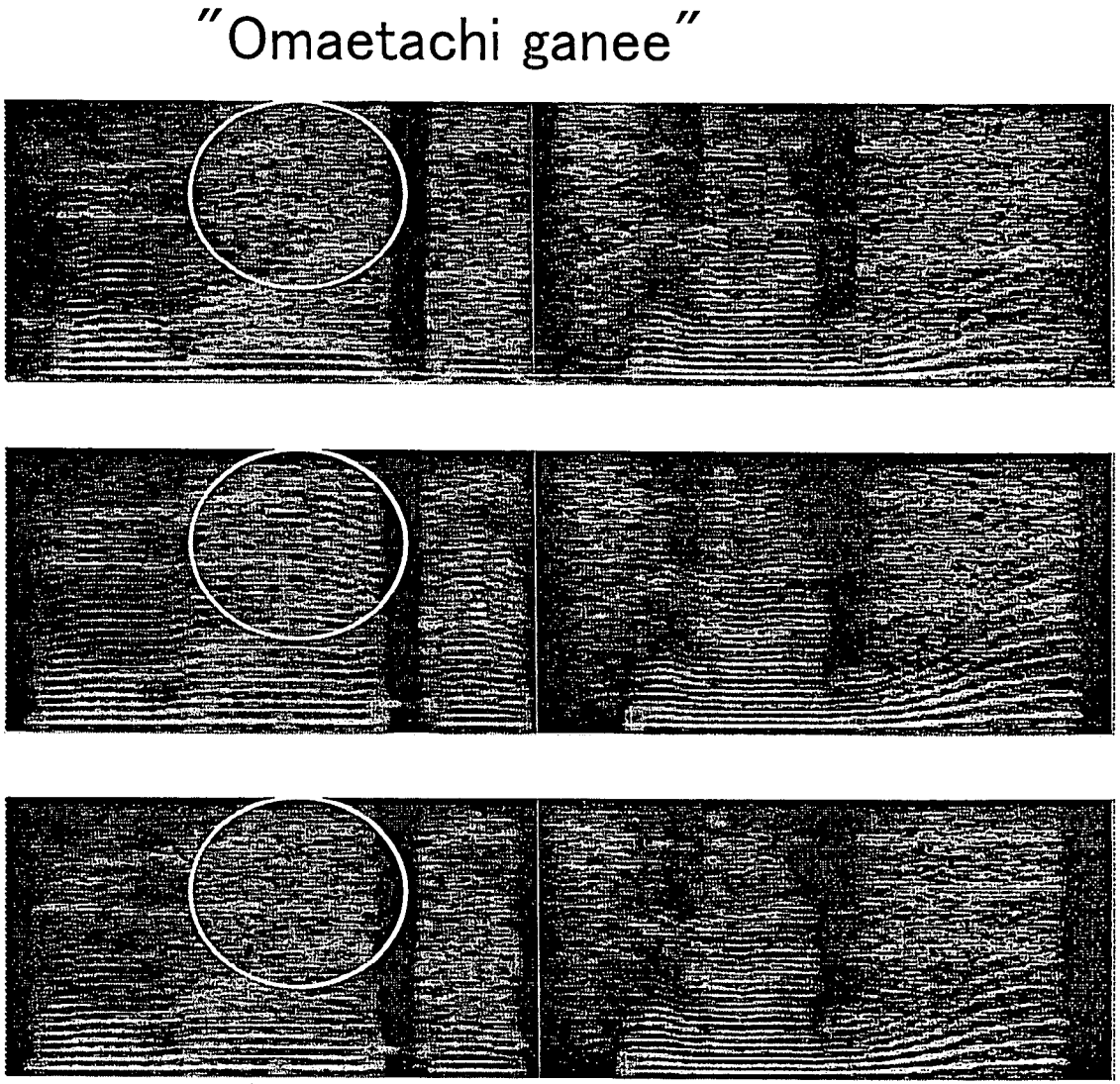
FIGS. 7(*a*) to 7(*c*) show sound spectrograms of a text "omaetachi ganee (you are)", in which (a) represents original speech, (b) synthesized speech with no fluctuation imparted, and (c) synthesized speech with fluctuation imparted to "e" of "omaetachi".
Figure 8:
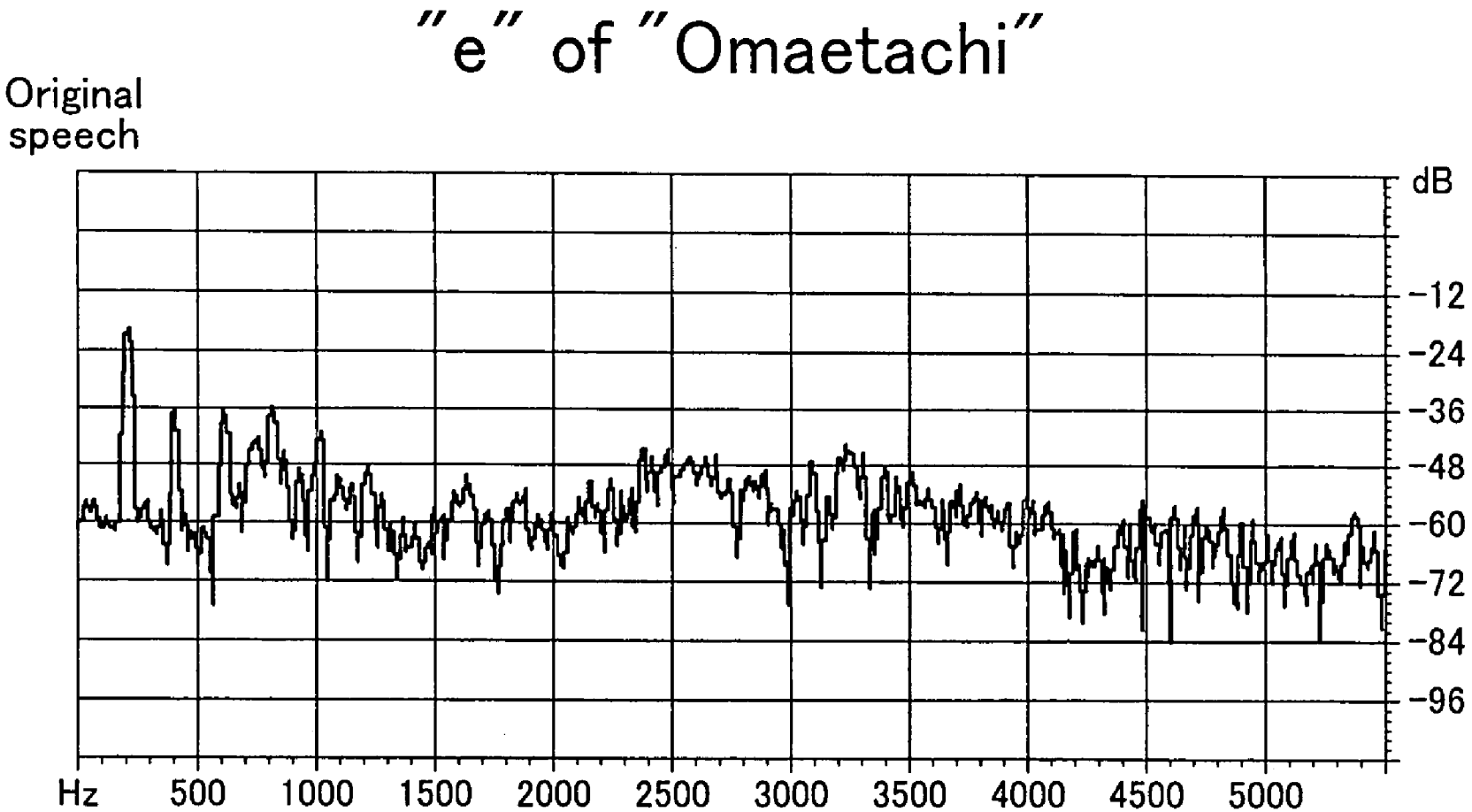
FIG. 8 is a view showing a spectrum of the "e" portion of "omaetachi" (original speech).
Figure 9A:
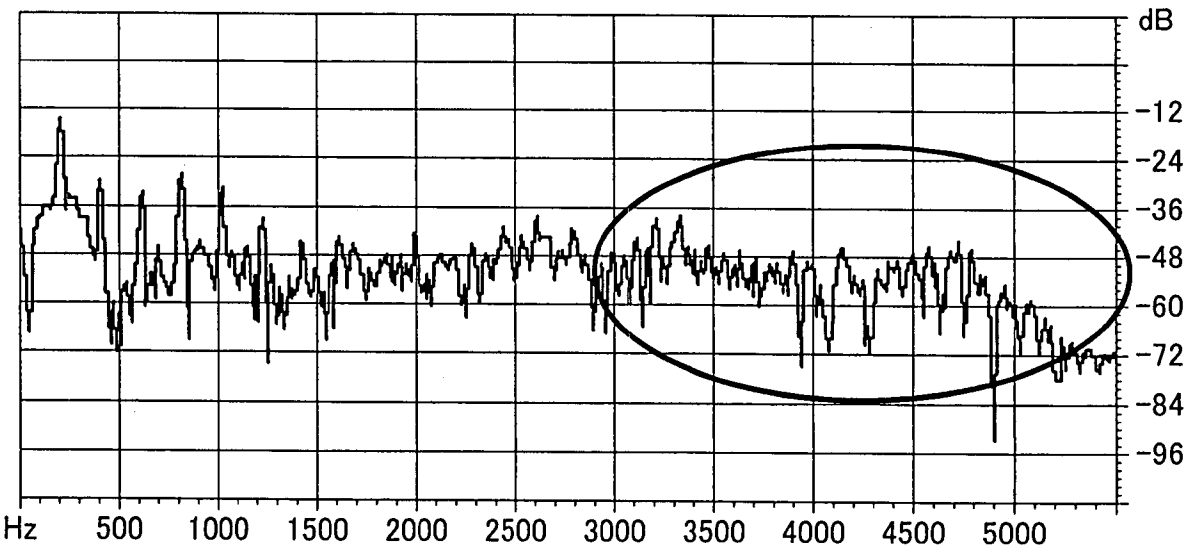
FIGS. 9(*a*) and 9(*b*) are views showing spectra of the "e" portion of "omaetachi", in which (a) represents the synthesized speech with fluctuation imparted and (b) the synthesized speech with no fluctuation imparted.
Figure 9B:
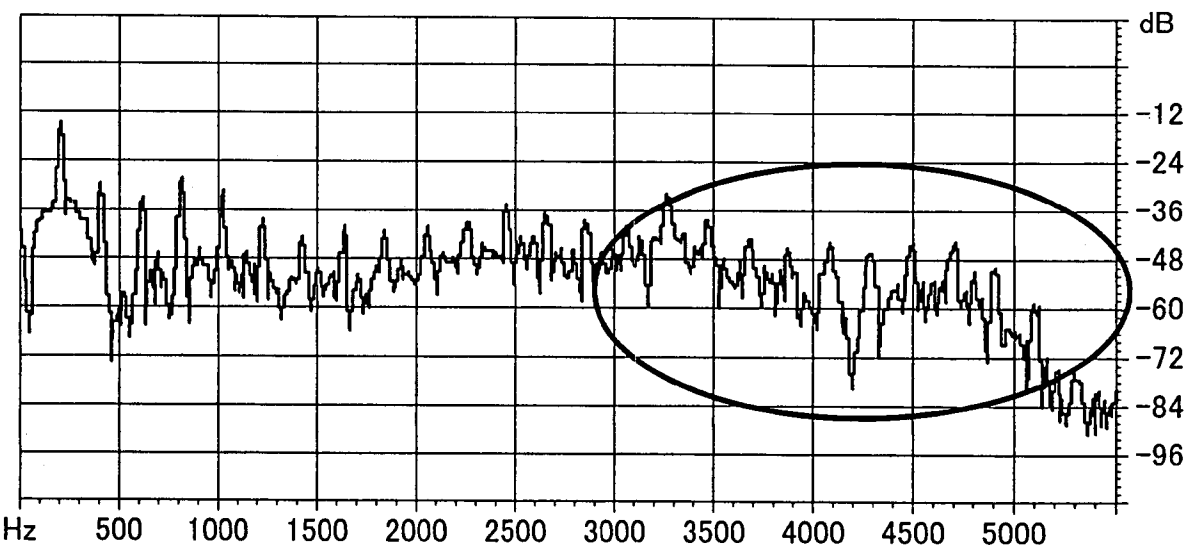

The series of processing from the cutting of waveforms to the superimposition described above is shown in FIGS. 5 and 6. FIG. 5 shows a case where the pitch is not changed, while FIG. 6 shows a case where the pitch is changed. FIGS. 7 to 9 respectively show spectrum representations of original speech, synthesized speech with no fluctuation imparted and synthesized speech with fluctuation imparted to "e" of "omae".

Example of Timing and Frequency Domain at Which Fluctuation is Imparted

Figure 11:
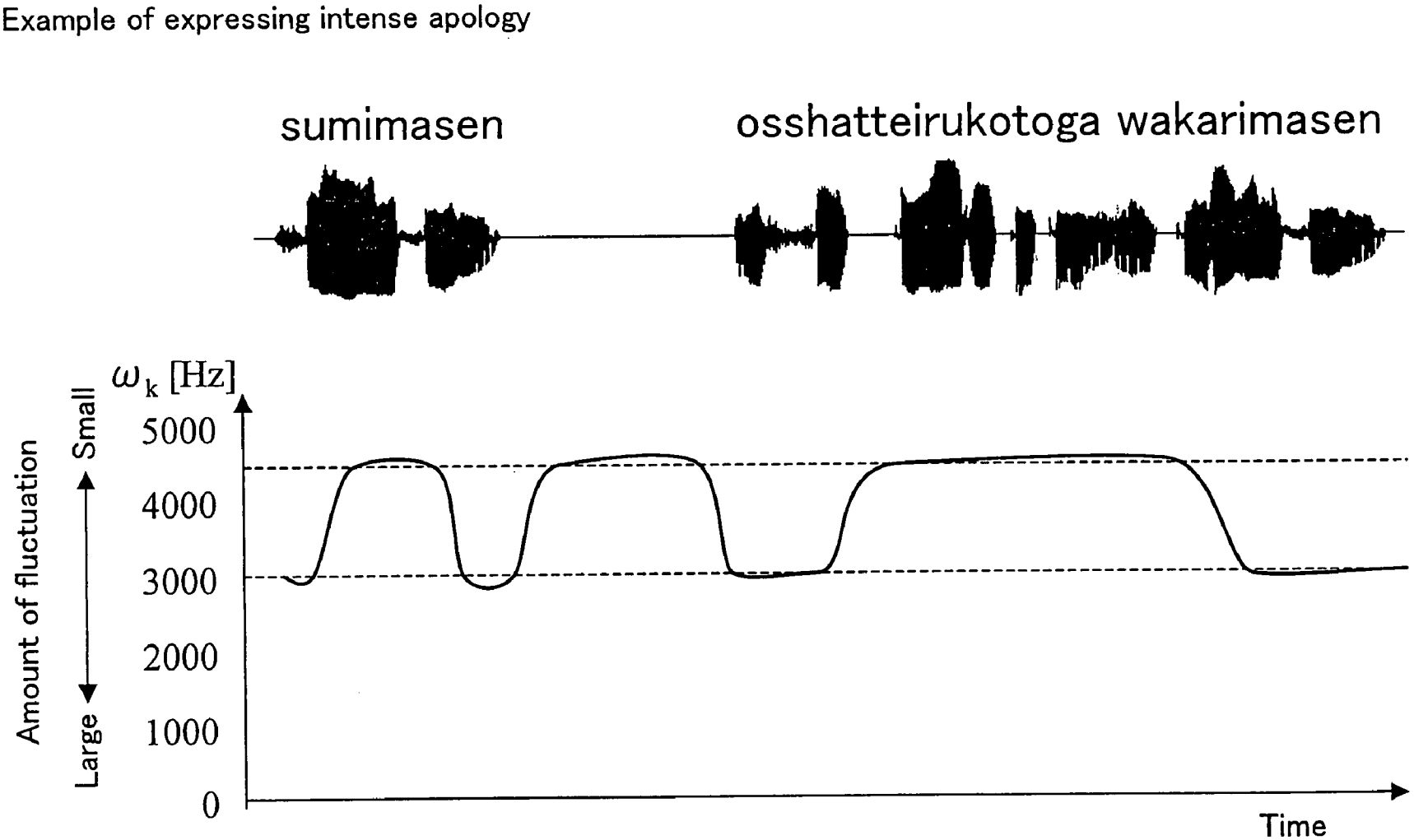
FIG. 11 is a view showing the amount of fluctuation imparted when feelings of intense apology are given to synthesized speech.

In the interface shown in FIG. 1, various types of feelings can be given to synthesized speech by controlling the timing and the frequency domain at which fluctuation is imparted by the phase operation portion 35. FIG. 10 shows an example of the correspondence between the types of feelings to be given to synthesized speech and the timing and the frequency domain at which fluctuation is imparted. FIG. 11 shows the amount of fluctuation imparted when feelings of intense apology are given to synthesized speech of "sumimasen, osshatteiru kotoga wakarimasen (I'm sorry, but I don't catch what you are saying)".

Example of Interaction

As described above, the interactive processing section 20 shown in FIG. 1 determines the type of feelings given to synthesized speech and controls the phase operation portion 35 so that phase fluctuation is imparted at timing and a frequency domain corresponding to the type of feelings. By this processing, the interaction with the user is made smooth.

Figure 12:
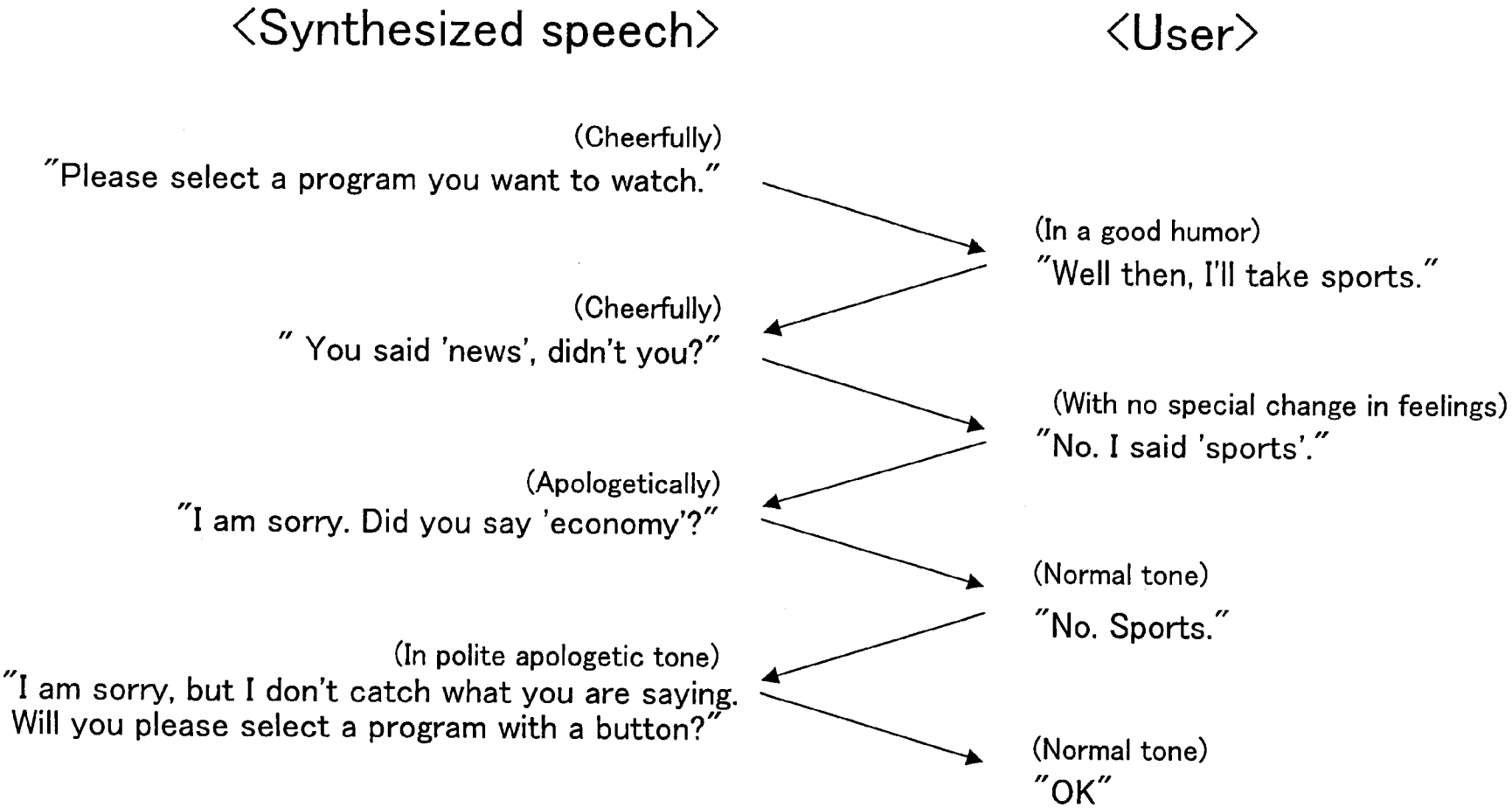
FIG. 12 is a view showing an example of interaction with the user expected when the speech interactive interface shown in FIG. 1 is mounted in a digital TV set.

FIG. 12 shows an example of interaction with the user when the speech interaction interface shown in FIG. 1 is mounted in a digital TV set. Synthesized speech, "Please select a program you want to watch", tinted with cheerful feelings (intermediate joy) is produced to urge the user to select a program. In response to this, the user utters a desired program in a good humor ("Well then, I'll take sports."). The speech recognition section 10 recognizes this utterance of the user and produces synthesized speech, "You said 'news', didn't you?", to confirm the recognition result with the user. This synthesized speech is also tinted with cheerful feelings (intermediate joy). Since the recognition is wrong, the user utters the desired program again ("No. I said 'sports'"). Since this is the first wrong recognition, the user does not especially change the feelings. The speech recognition section 10 recognizes this utterance of the user, and the dialogue processing section 20 determines that the last recognition result was wrong. The dialogue processing section 20 then instructs the speech synthesis section 30 to produce synthesized speech, "I am sorry. Did you say 'economy'?" to confirm the recognition result with the user again. Since this is the second confirmation, the synthesized speech is tinted with apologetic feelings (intermediate apology). Although the recognition result is wrong again, the user does not feel offensive because the synthesized speech is apologetic and utters the desired program the third time ("No. Sports"). The dialogue processing section 20 determines from this utterance that the speech recognition section 10 failed in proper recognition. With the failure of the recognition for two continuous times, the dialogue processing section 20 instructs the speech synthesis section 30 to produce synthesized speech "I am sorry, but I don't catch what you are saying. Will you please select a program with a button." to urge the user to select a program by pressing a button of a remote controller, not by speech. In this situation, more apologetic feelings (intense apology) than the previous one are given to the synthesized speech. In response to this, the user selects the desired program with a button of the remote controller without feeling offensive.

Figure 13:
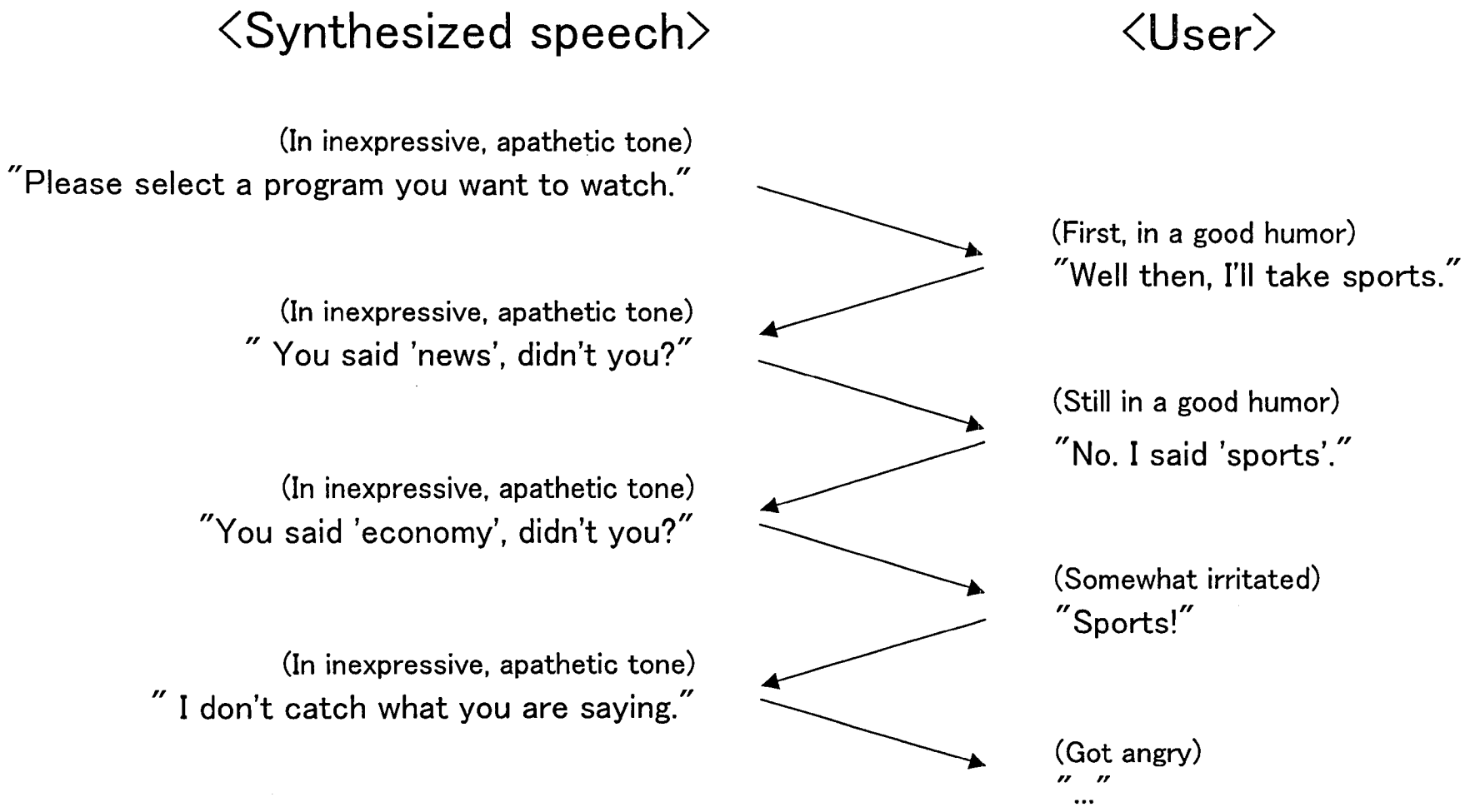
FIG. 13 is a view showing a flow of interaction with the user expected when monotonous synthesized speech is used in any situation.

The above flow of interaction with the user is expected when feelings appropriate to the situation are given to synthesized speech. Contrarily, if the interface responds with synthesized speech monotonous in any situation, a flow of interaction with the user will be as shown in FIG. 13. As shown in FIG. 13, if the interface responds with inexpressive, apathetic synthesized speech, the user will become increasingly offensive as wrong recognition is repeated. The voice of the user changes with increase of the offensive feelings, and as a result, the precision of the recognition by the speech recognition section 10 decreases.

Effect

Humans use various ways to express their feelings. For example, facial expressions, gestures and signs are used. In speech, various ways such as intonation patterns, the speed and how to place a pause are used. Humans put these means to full use to exert their expression capabilities, not merely expressing their feelings only with change in pitch pattern. Therefore, to express feelings effectively by speech synthesis, it is necessary to use various expressing ways in addition to the pitch pattern. In observation of speech spoken with emotion, it is found that whispering speech is used very effectively. Whispering speech contains many noise components. To generate noise, the following two methods are largely used.

1. Adding noise
2. Modulating the phase randomly (imparting fluctuation).

The method 1 is easy but poor in sound quality. The method 2 is good in sound quality, and therefore has recently received attention. In Embodiment 1, therefore, whispering speech (noise-contained synthesized speech) is obtained effectively using the method 2, to improve the naturalness of the synthesized speech.

Because pitch waveforms cut from a natural speech waveform are used, the fine structure of the spectrum of natural speech can be reproduced. Roughness, which may occur at change of the pitch, can be suppressed by removing fluctuation components intrinsic to the natural speech waveform by the phase stylization portion 352. The buzzer-like sound, which may be generated by removing the fluctuation, can be reduced by newly imparting phase fluctuation to a high frequency component by the phase diffusion portion 353.

Alteration

Figure 14A:
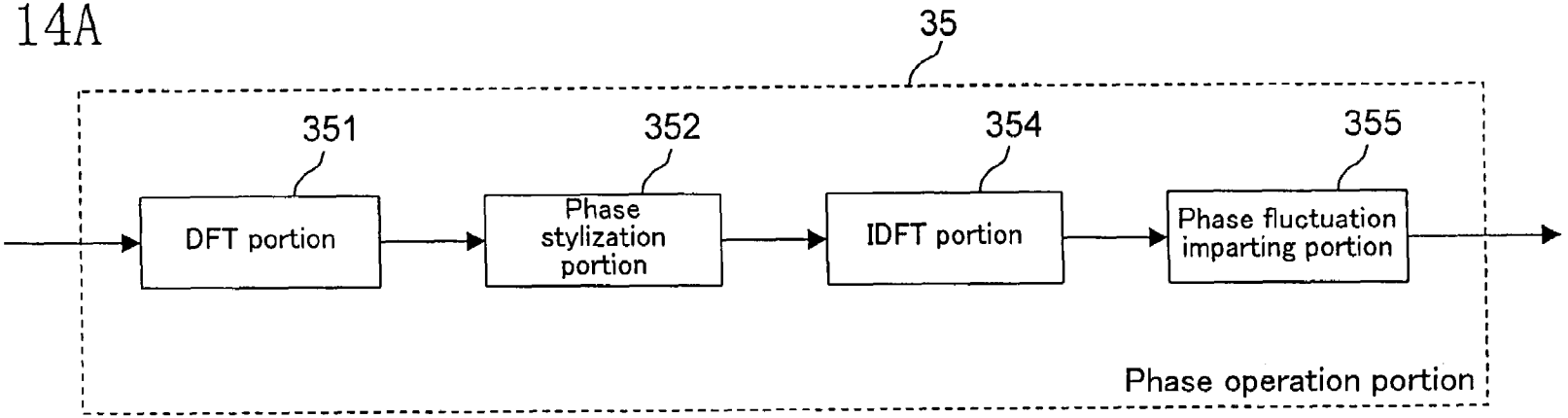
FIG. 14(*a*) is a block diagram showing an alteration to the phase operation portion.
Figure 14B:
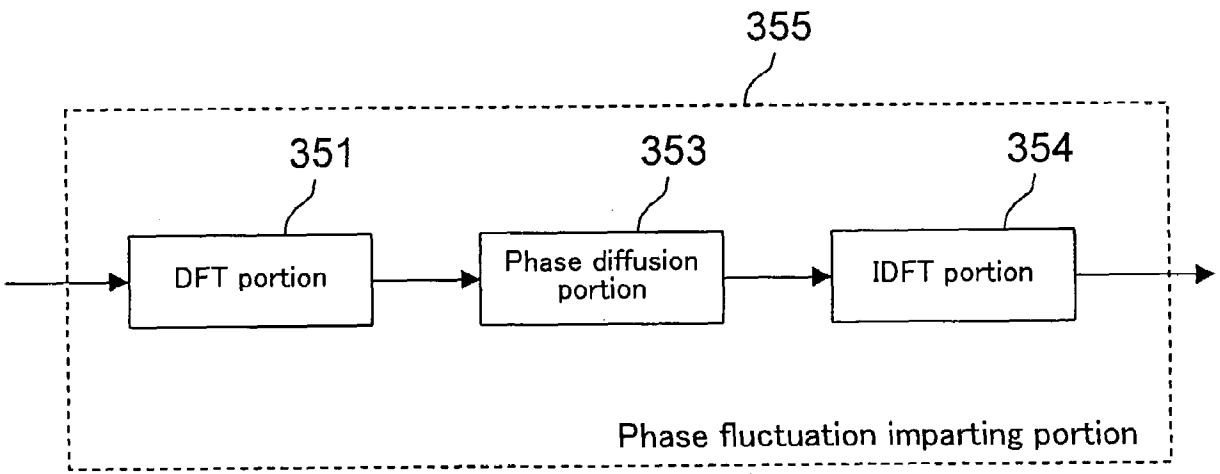
Figure 15:
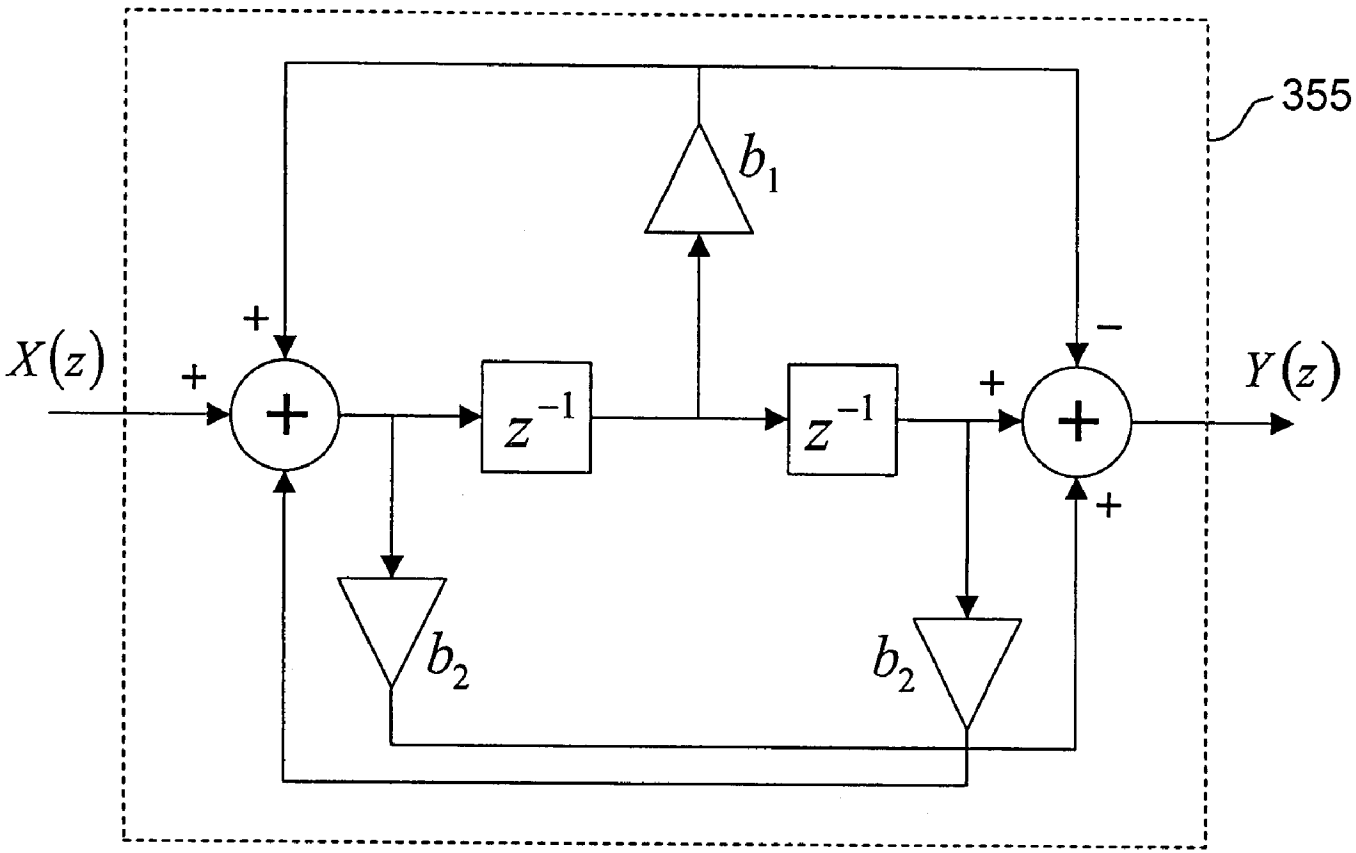
FIG. 15 is a block diagram of a circuit as another example of implementation of the phase fluctuation imparting portion.

In the above description, the phase operation portion 35 followed the procedure of 1) DFT, 2) phase standardization, 3) phase diffusion in high frequency range and 4) IDFT. The phase standardization and the phase diffusion in high frequency range are not necessarily performed simultaneously. In some cases, it is more convenient to perform the IDFT and then newly perform processing corresponding to the phase diffusion in high frequency range, depending on the conditions. In such cases, the procedure of the processing by the phase operation portion 35 may be changed to 1) DFT, 2) phase standardization, 3) IDFT and 4) imparting of phase fluctuation. FIG. 14(*a*) shows an internal configuration of the phase operation portion 35 in this case, where the phase diffusion portion 353 is omitted, and instead a phase fluctuation imparting portion 355 for performing time-domain processing follows the IDFT portion 354. The phase fluctuation imparting portion 355 may be implemented with a configuration as shown in FIG. 14(*b*). The phase fluctuation imparting portion 355 may otherwise be implemented with a configuration shown in FIG. 15, as completely time-domain processing. The operation in this implementation example will be described.

Expression 8 represents a transfer function of a secondary all-pass circuit.

$$H(z) = \frac{z^{-2} - b_1 z^{-1} + b_2}{1 - b_1 z^{-1} + b_2 z^{-2}} = \frac{z^{-2} - 2r\cos\omega_c T \cdot z^{-1} + r^2}{1 - 2r\cos\omega_c T \cdot z^{-1} + r^2 z^{-2}} \quad \text{Expression 8}$$

Using this circuit, a group delay characteristic having the peak of Expression 9 with $\omega_c$ in the center can be obtained.

$$T(1+r)/T(1-r) \quad \text{Expression 9}$$

In view of the above, fluctuation can be given to the phase characteristic by setting $\omega_c$ in a high frequency range and changing the value of r randomly every pitch waveform within the range of $0<r<1$. In Expressions 8 and 9, T is the sampling period.

Embodiment 2

In Embodiment 1, the phase standardization and the phase diffusion in high frequency range were performed in separate steps. Using this technique of separate processing, it is possible to add a different type of operation to pitch waveforms once shaped by the phase standardization. In Embodiment 2, once-shaped pitch waveforms are clustered to reduce the data storage capacity.

Figure 16:
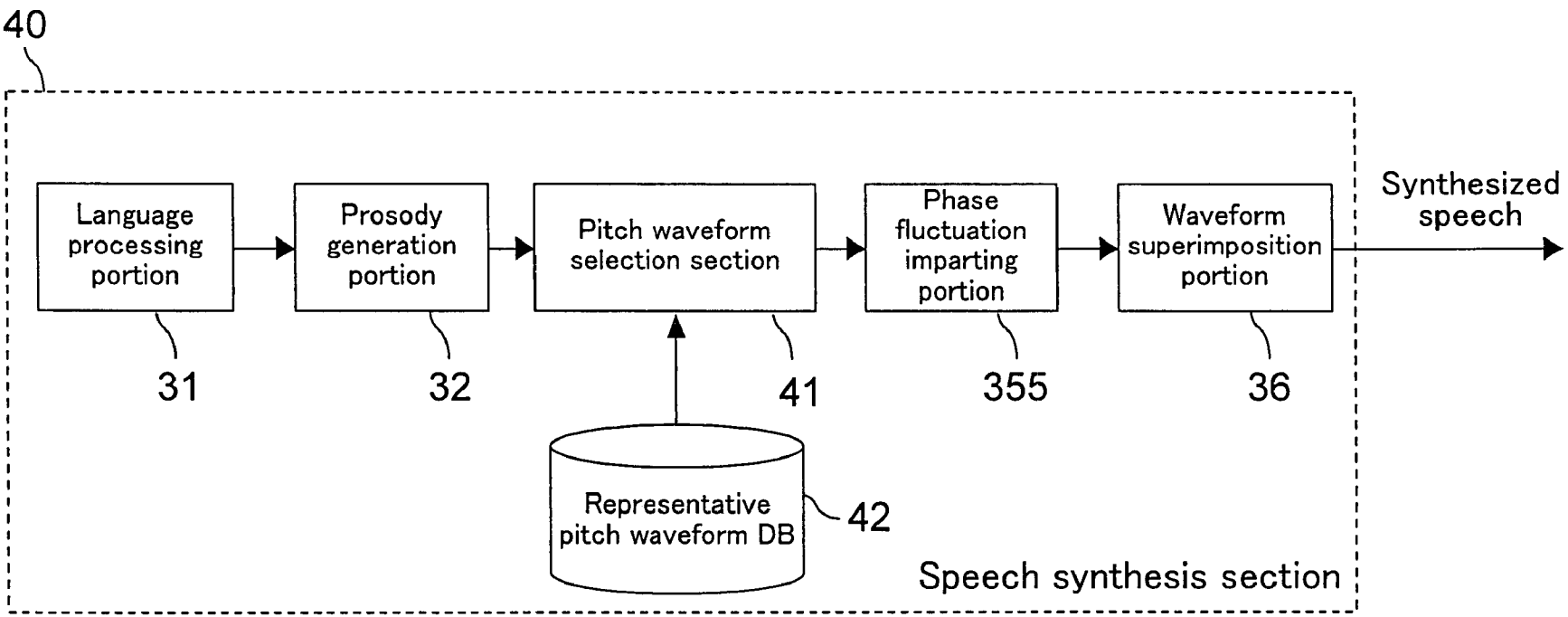
FIG. 16 is a view showing a configuration of a speech synthesis section in Embodiment 2.

The interface in Embodiment 2 includes a speech synthesis section 40 shown in FIG. 16, in place of the speech synthesis section 30 shown in FIG. 1. The other components of the interface in Embodiment 2 are the same as those shown in FIG. 1. The speech synthesis section 40 shown in FIG. 16 includes a language procession portion 31, a prosody generation portion 32, a pitch waveform selection portion 41, a representative pitch waveform database (DB) 42, a phase fluctuation imparting portion 355 and a waveform superimposition portion 36.

Figure 17A:
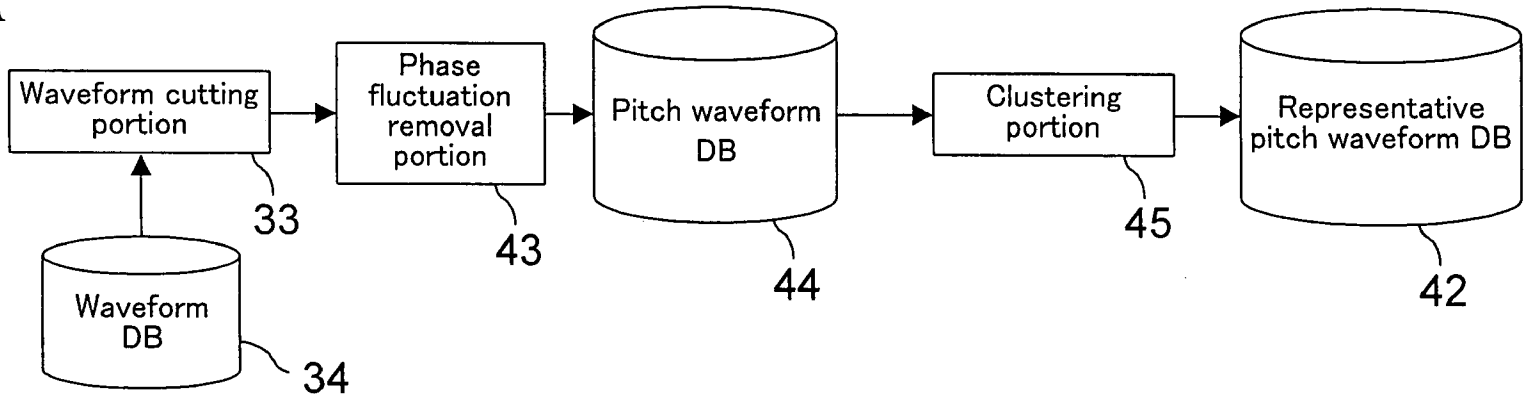
FIG. 17(*a*) is a block diagram showing a configuration of a device for producing representative pitch waveforms to be stored in a representative pitch waveform DB.
Figure 17B:
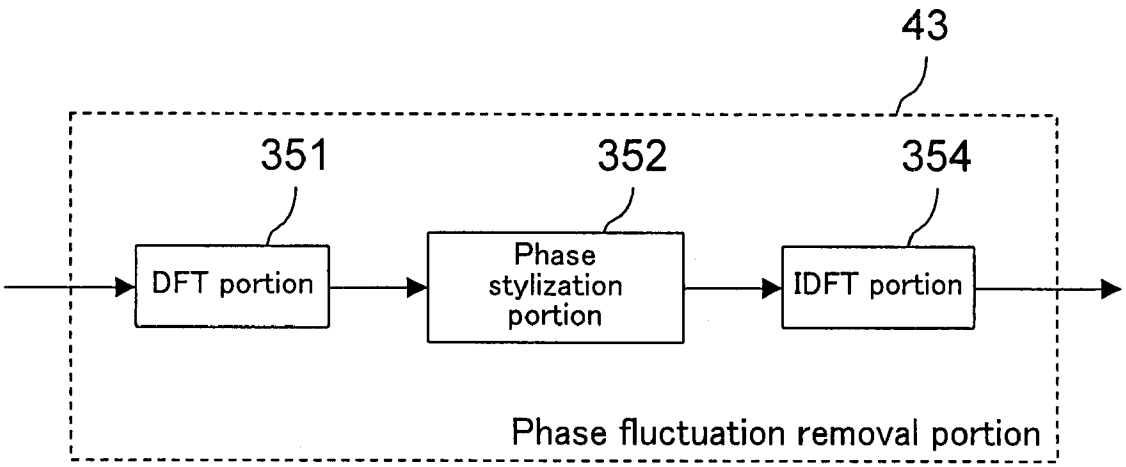

In the representative pitch waveform DB 42, stored in advance are representative pitch waveforms obtained by a device shown in FIG. 17(*a*) (device independent of the speech interaction interface). The device shown in FIG. 17(*a*) includes a waveform DB 34 of which output is connected to a waveform cutting portion 33. The operations of these two components are the same as those in Embodiment 1. The output of the waveform cutting portion 33 is connected to a phase fluctuation removal portion 43. The pitch waveforms are deformed at this stage. FIG. 17(*b*) shows a configuration of the phase fluctuation removal portion 43. The shaped pitch waveforms are all stored temporarily in the pitch waveform DB 44. Once the shaping of all pitch waveforms is completed, the pitch waveforms stored in the pitch waveform DB 44 are grouped into clusters each composed of like waveforms by the clustering portion 45, and only a representative waveform of each cluster (for example, a waveform closest to the center of gravity of each cluster) is stored in the representative pitch waveform DB 42.

A pitch waveform closest to a desired pitch waveform is selected by the pitch waveform selection portion 41, and is output to the phase fluctuation imparting portion 355, in which fluctuation is imparted to the high phase. The fluctuation-imparted pitch waveform is then transformed to synthesized speech by the waveform superimposition portion 36.

It is considered that by shaping the pitch waveforms by removing phase fluctuation as described above, the probability that any pitch waveforms are similar to each other increases, and as a result, the effect of reducing the storage capacity due to the clustering increases. In other words, the storage capacity (storage capacity of the DB 42) necessary for storing the pitch waveform data can be reduced. Typically, it will be intuitionally understood that the pitch waveforms become symmetric by setting 0 for all phase components and this increases the probability that any waveforms are similar to each other.

There are many clustering techniques. In general, clustering is an operation in which the scale of the distance between data units is defined and data units close in distance are grouped as one cluster. Herein, the technique is not limited to specific one. As the scale of the distance, Euclidean distance between pitch waveforms and the like may be used. As an example of the clustering technique, that described in Leo Breiman, "Classification and Regression Trees", CRC Press, ISBN 0412048418 may be mentioned.

Embodiment 3

To enhance the effect of reducing the storage capacity by clustering, that is, the clustering efficiency, it is effective to normalize the amplitude and the time length, in addition to the shaping of the pitch waveforms by removing phase fluctuation. In Embodiment 3, a step of normalizing the amplitude and the time length is provided at the storage of the pitch waveforms. Also, the amplitude and the time length are changed appropriately according to synthesized speech at the reading of the pitch waveforms.

Figure 18A:
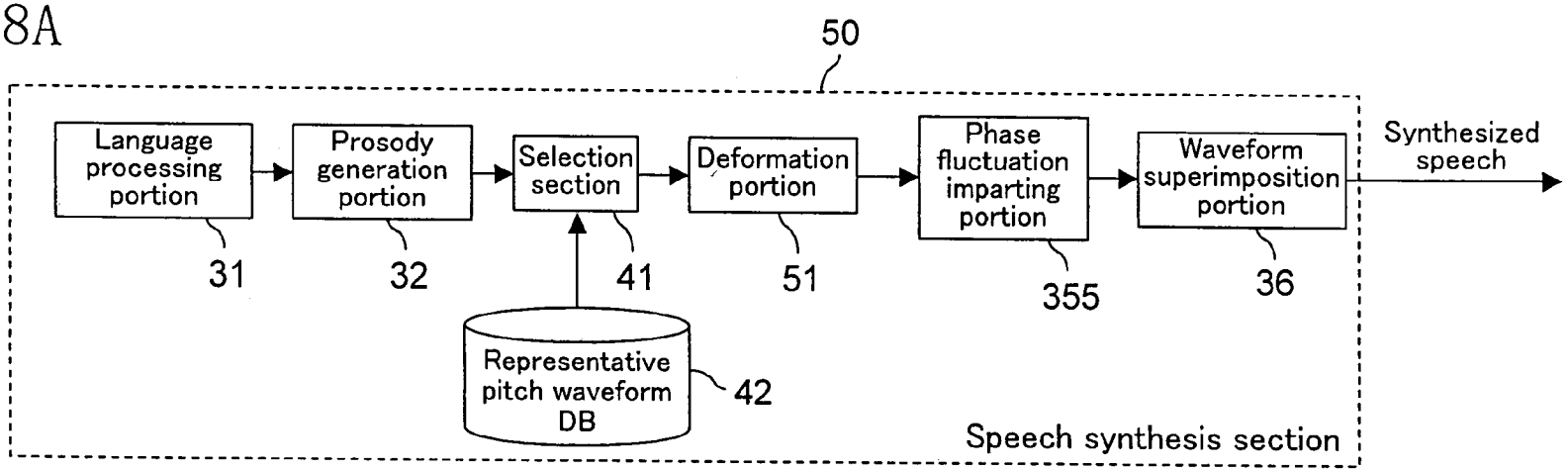
FIG. 18(*a*) is a block diagram showing a configuration of a speech synthesis section in Embodiment 3.
Figure 18B:
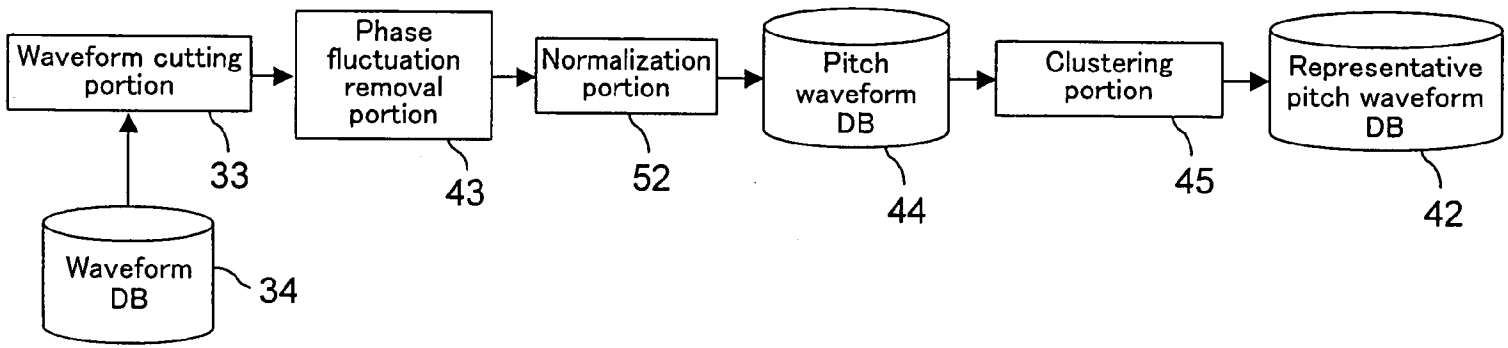

The interface in Embodiment 3 includes a speech synthesis section 50 shown in FIG. 18(*a*), in place of the speech synthesis section 30 shown in FIG. 1. The other components of the interface in Embodiment 3 are the same as those shown in FIG. 1. The speech synthesis section 50 shown in FIG. 18(*a*) includes a deformation portion 51 in addition to the components of the speech synthesis section 40 shown in FIG. 16. The deformation portion 51 is provided between the pitch waveform selection portion 41 and the phase fluctuation imparting portion 355.

In the representative pitch waveform DB 42, stored in advance are representative pitch waveforms obtained from a device shown in FIG. 18(*b*) (device independent of the speech interaction interface). The device shown in FIG. 18(*b*) includes a normalization portion 52 in addition to the components of the device shown in FIG. 17(*a*). The normalization portion 52 is provided between the phase fluctuation removal portion 43 and the pitch waveform DB 44. The normalization portion 52 forcefully transforms the input shaped pitch waveforms to have a specific length (for example, 200 samples) and a specific amplitude (for example, 30000). As a result, all the shaped pitch waveforms input into the normalization portion 52 will have the same length and amplitude when they are output from the normalization portion 52. This means that all the waveforms stored in the representative pitch waveform DB 42 have the same length and amplitude.

The pitch waveforms selected by the pitch waveform selection portion 41 are also naturally the same in length and amplitude. Therefore, they are deformed to have lengths and amplitudes according to the intention of the speech synthesis by the deformation portion 51.

Figure 19:
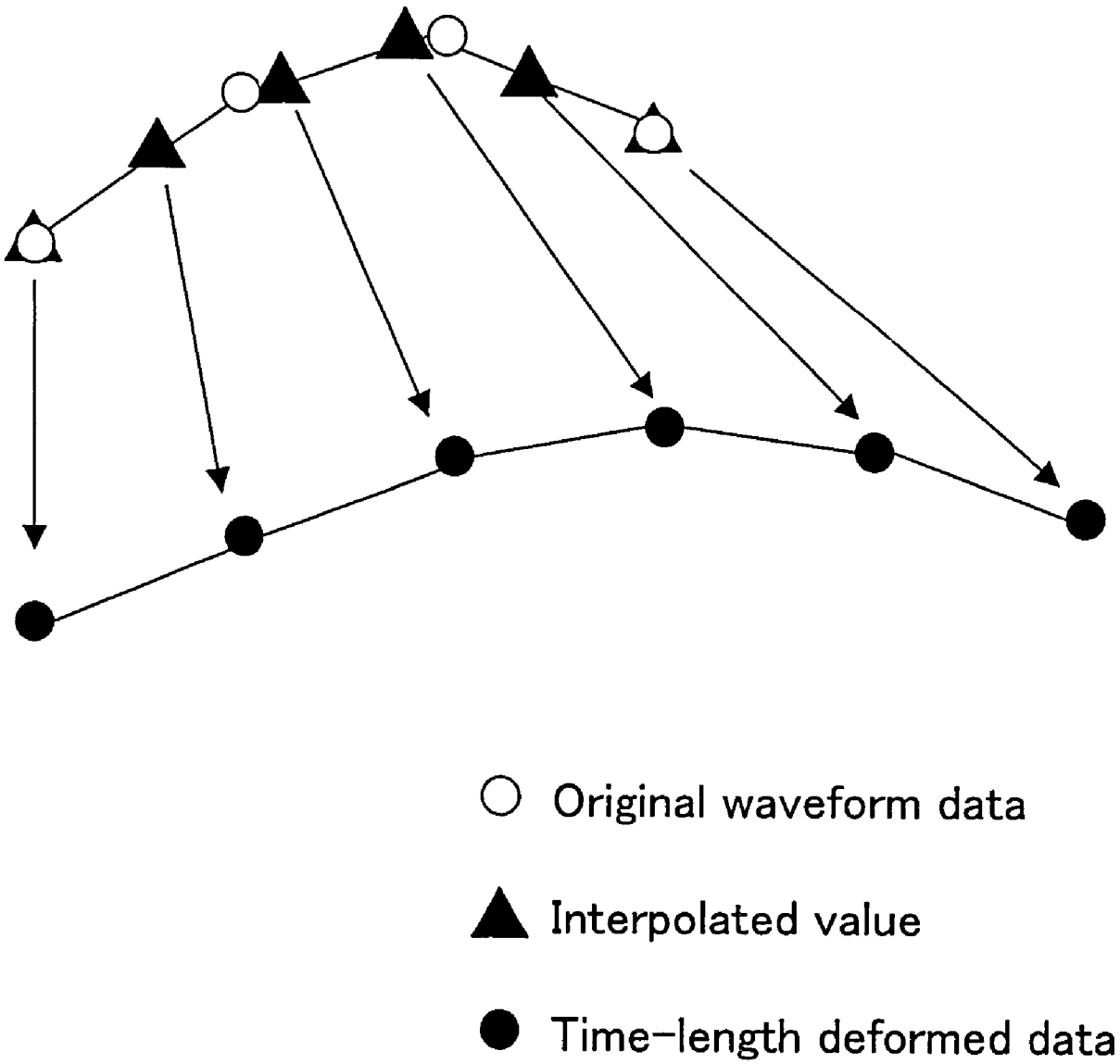
FIG. 19 is a view showing how the time length is deformed in a normalization portion and a deformation portion.

In the normalization portion 52 and the deformation portion 51, the time length may be deformed using linear interpolation as shown in FIG. 19, and the amplitude may be deformed by multiplying the value of each sample by a constant, for example.

In Embodiment 3, the efficiency of clustering of pitch waveforms enhances. In comparison with Embodiment 2, the storage capacity can be smaller when the sound quality is the same, or the sound quality is higher when the storage capacity is the same.

Embodiment 4

In Embodiment 3, to enhance the clustering efficiency, the pitch waveforms were shaped and normalized in amplitude and time length. In Embodiment 4, another method will be adopted to enhance the clustering efficiency.

In the previous embodiments, time-domain pitch waveforms were clustered. That is, the phase fluctuation removal portion 43 shapes waveforms by following the steps of 1) transforming pitch waveforms to frequency-domain signal representation by DFT, 2) removing phase fluctuation in the frequency domain and 3) resuming time-domain signal representation by IDFT. Thereafter, the clustering portion 45 clusters the shaped pitch waveforms.

In the speech synthesis section, the phase fluctuation imparting portion 355 implemented as in FIG. 14(*b*) performs the processing following the steps of 1) transforming pitch waveforms to frequency-domain signal representation by DFT, 2) diffusing the high phase in the frequency domain and 3) resuming time-domain signal representation by IDFT.

As is apparent from the above, the step 3 in the phase fluctuation removal portion 43 and the step 1 in the phase fluctuation imparting portion 355 relate to transformations opposite to each other. These steps can therefore be omitted by executing clustering in the frequency domain.

Figure 20A:
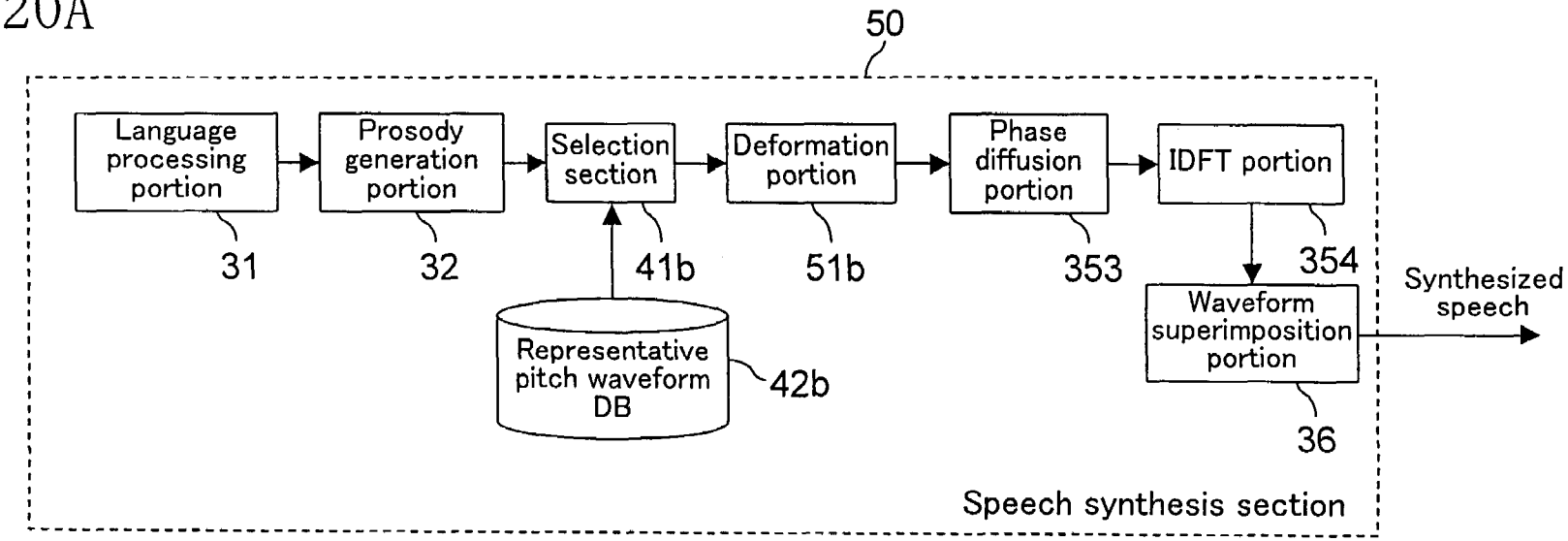
FIG. 20(*a*) is a block diagram showing a configuration of a speech synthesis section in Embodiment 4.
Figure 20B:
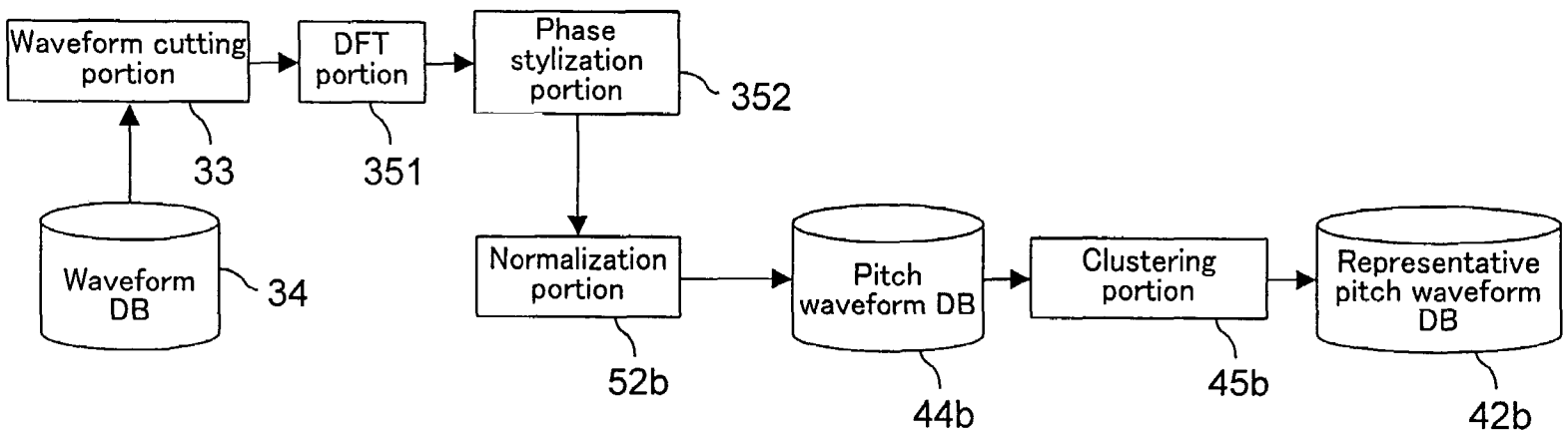

FIG. 20 shows a configuration in Embodiment 4 obtained based on the idea described above. The phase fluctuation removal portion 43 in FIG. 18 is replaced with a DFT portion 351 and a phase stylization portion 352 of which output is connected to the normalization portion. The normalization portion 52, the pitch waveform DB 44, the clustering portion 45, the representative pitch waveform DB 42, the selection portion 41 and the deformation portion 51 are respectively replaced with a normalization portion 52*b*, a pitch waveform DB 44*b*, a clustering portion 45*b*, a representative pitch waveform DB 42*b*, a selection portion 41*b* and a deformation portion 51*b*. The phase fluctuation imparting portion 355 in FIG. 18 is replaced with a phase diffusion portion 353 and an IDFT portion 354.

Note that the components having the subscript b, like the normalization portion 52*b*, perform frequency-domain processing in place of the processing performed by the components shown in FIG. 18. This will be specifically described as follows.

The normalization portion 52*b* normalizes the amplitude of pitch waveforms in a frequency domain. That is, all pitch waveforms output from the normalization portion 52*b* have the same amplitude in a frequency domain. For example, when pitch waveforms are represented in a frequency domain as in Expression 2, the processing is made so that the values represented by Expression 10 are the same.

$$\max_{0 \le k \le N-1} |S_i(k)| \quad \text{Expression 10}$$

Figure 21:
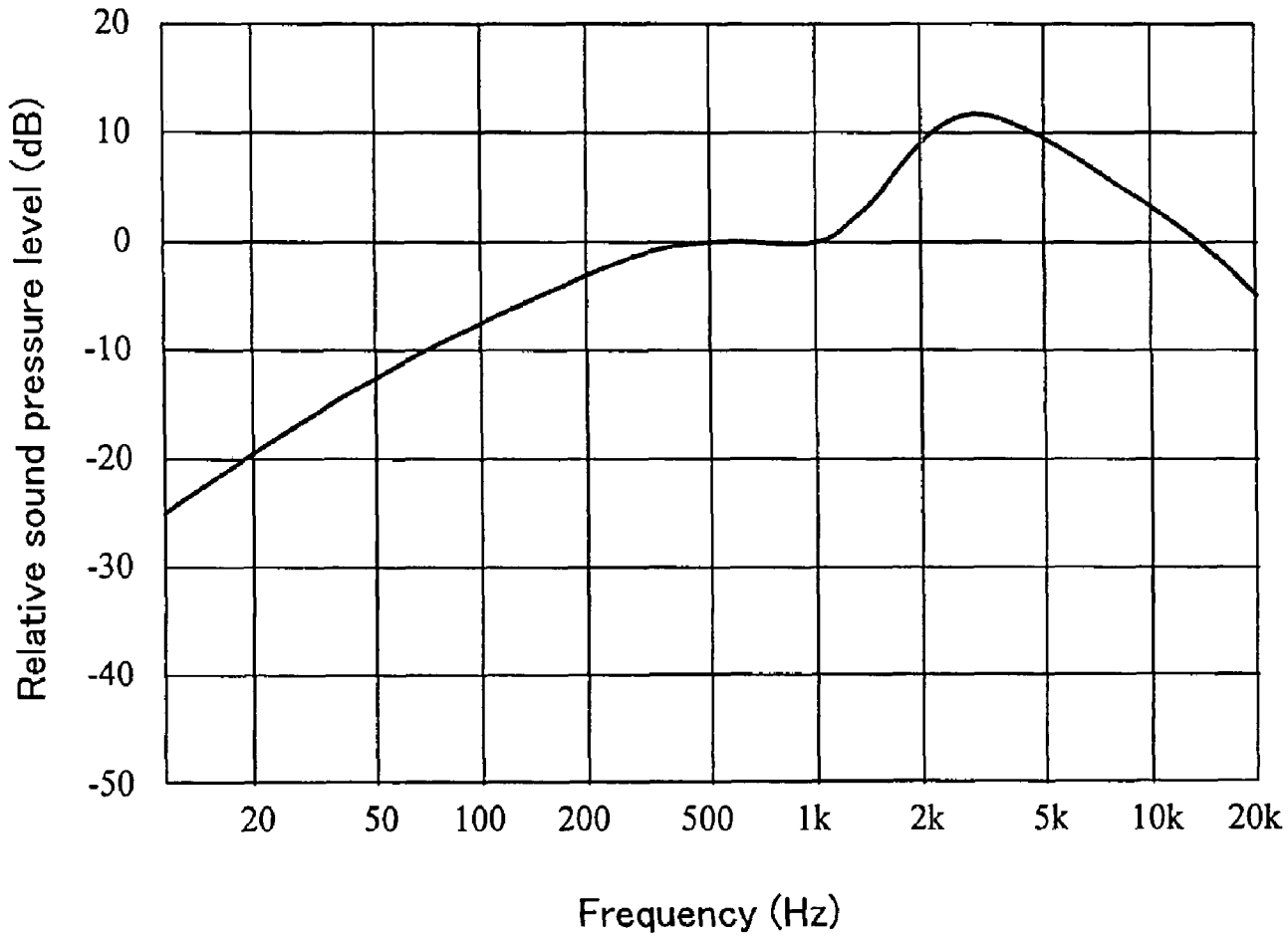
FIG. 21 is a view showing an example of a weighting curve.

The pitch waveform DB 44*b* stores the DFT-done pitch waveforms in the frequency-domain representation. The clustering portion 45*b* clusters the pitch waveforms in the frequency-domain representation. For clustering, it is necessary to define the distance D(i,j) between pitch waveforms. This definition may be made as in Expression (11), for example.

$$D(i, j) = \sqrt{\sum_{K=0}^{N/2-1} (S_i(k) - S_j(k))^2 w(k)} \quad \text{Expression 11}$$

where w(k) is the frequency weighting function. By performing frequency weighting, a difference in the sensitivity of the auditory sense depending on the frequency can be reflected on the distance calculation, and this further enhances the sound quality. For example, a difference in a low frequency band in which the sensitivity of the auditory sense is very low is not perceived. It is therefore unnecessary to include a level difference in this frequency band in the calculation. More preferably, a perceptual weighting function and the like introduced in "Shinban Choukaku to Onsei (Auditory sense and Voice, New Edition)" (The Institute of Electronics and Communication Engineers, 1970), Section 2 Psychology of auditory sense, 2.8.2 equal noisiness contours, FIG. 2.55 (p. 147). FIG. 21 shows an example of a perceptual weighting function presented in this literature.

This embodiment has a merit of reducing the calculation cost because each one step of DFT and IDFT is omitted.

Embodiment 5

In synthesis of speech, some deformation must be given to the speech waveform. In other words, the speech must be transformed to have a prosodic feature different from the original one. In Embodiments 1 to 3, the speech waveform was directly deformed, by cutting of pitch waveforms and superimposition. Instead, a so-called parametric speech synthesis method may be adopted in which speech is once analyzed, replaced with a parameter, and then synthesized again. By adopting this method, degradation that may occur when a prosodic feature is deformed can be reduced. Embodiment 5 provides a method in which a speech waveform is analyzed and divided into a parameter and a source waveform.

Figure 22:
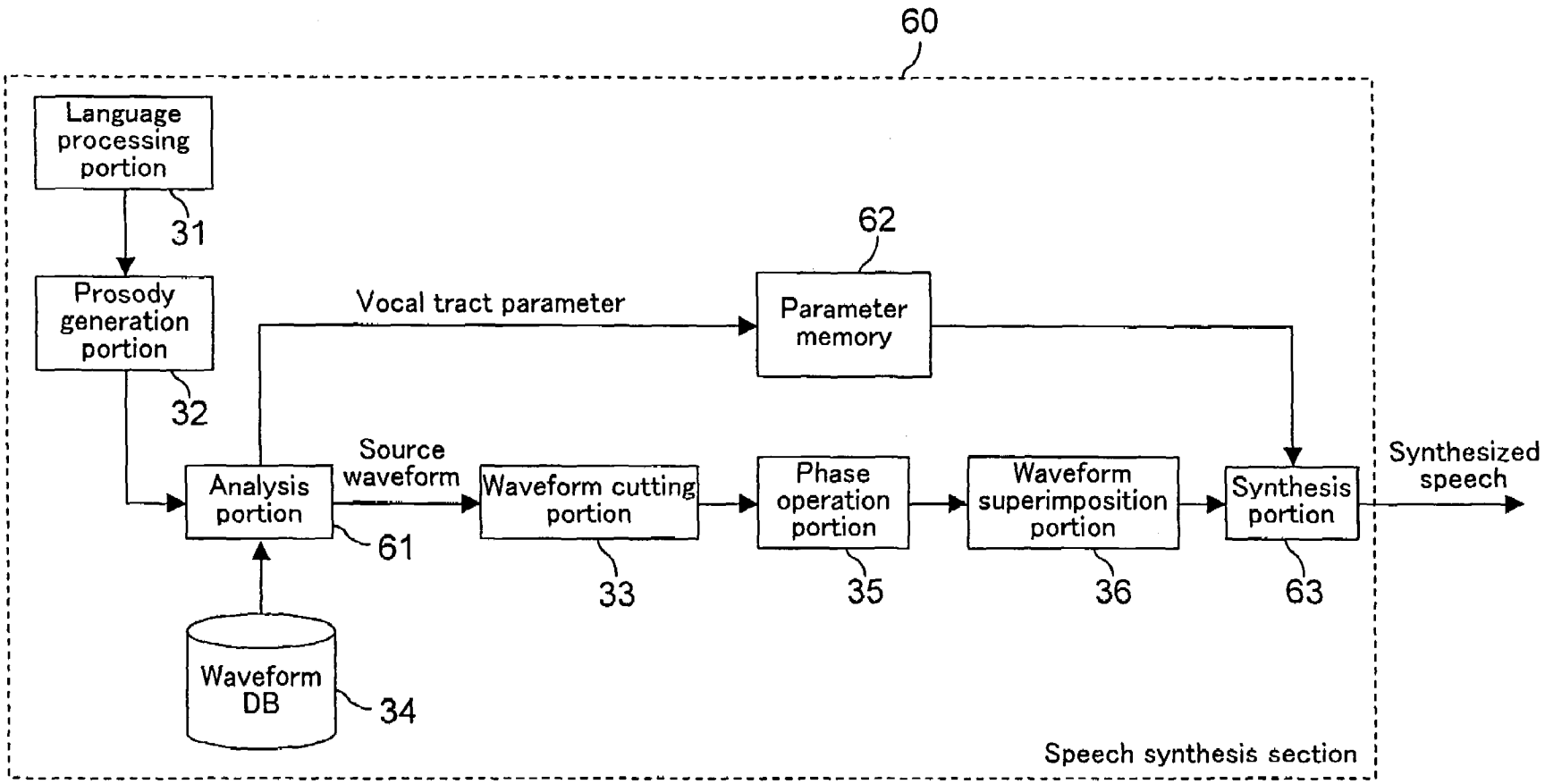
FIG. 22 is a view showing a configuration of a speech synthesis section in Embodiment 5.

The interface in Embodiment 5 includes a speech synthesis section 60 shown in FIG. 22, in place of the speech synthesis section 30 shown in FIG. 1. The other components of the interface in Embodiment 5 are the same as those shown in FIG. 1. The speech synthesis section 60 shown in FIG. 22 includes a language procession portion 31, a prosody generation portion 32, an analysis portion 61, a parameter memory 62, a waveform DB 34, a waveform cutting portion 33, a phase operation portion 35, a waveform superimposition portion 36 and a synthesis portion 63.

The analysis portion 61 divides a speech waveform received from the waveform DB 34 into two components of vocal tract and glottal, that is, a vocal tract parameter and a source waveform. The vocal tract parameter as one of the two components divided by the analysis portion 61 is stored in the parameter memory 62, while the source waveform as the other component is input into the waveform cutting portion 33. The output of the waveform cutting portion 33 is input into the waveform superimposition portion 36 via the phase operation portion 35. The configuration of the phase operation portion 35 is the same as that shown in FIG. 4. The output of the waveform superimposition portion 36 is a waveform obtained by deforming the source waveform, which has been subjected to the phase standardization and the phase diffusion, to have a target prosodic feature. This output waveform is input into the synthesis portion 63. The synthesis portion 63 transforms the received waveform to a speech waveform by adding the parameter output from the parameter memory 62.

The analysis portion 61 and the synthesis portion 63 may be made of a so-called LPC analysis synthesis system. In particular, a system that can separate the vocal tract and glottal characteristics with high precision may be used. Preferably, it is suitable to use an ARX analysis synthesis system described in literature "An Improved Speech Analysis-Synthesis Algorithm based on the Autoregressive with Exogenous Input Speech Production Model" (Otsuka et al., ICSLP 2000).

By configuring as described above, it is possible to provide good synthesized speech that is less degraded in sound quality even when the prosodic deformation amount is large and also has natural fluctuation.

The phase operation portion 35 may be altered as in Embodiment 1.

Embodiment 6

In Embodiment 2, shaped waveforms were clustered for reduction of the data storage capacity. This idea is also applicable to Embodiment 5.

Figure 23:
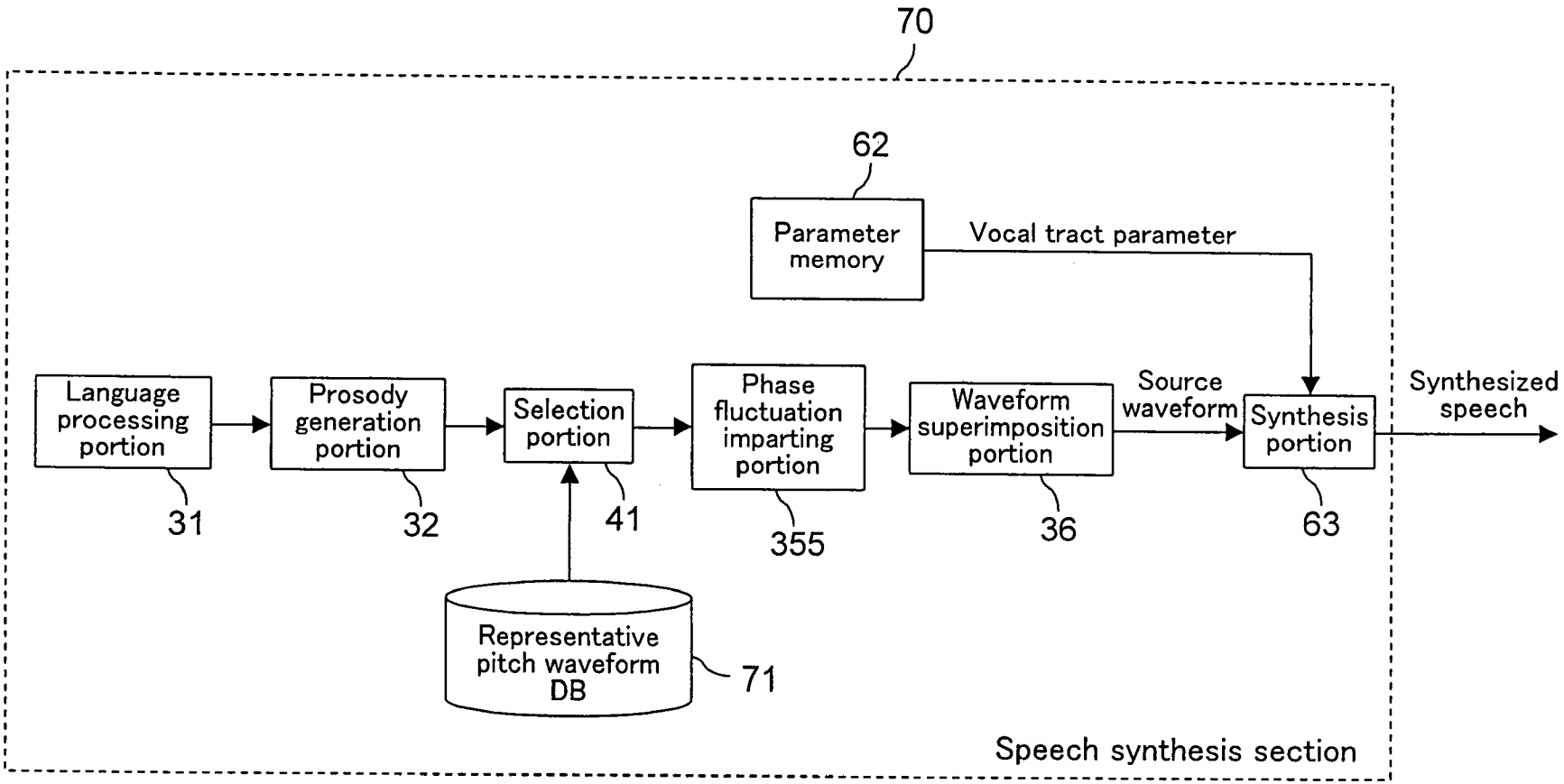
FIG. 23 is a view showing a configuration of a speech synthesis section in Embodiment 6.
Figure 24:
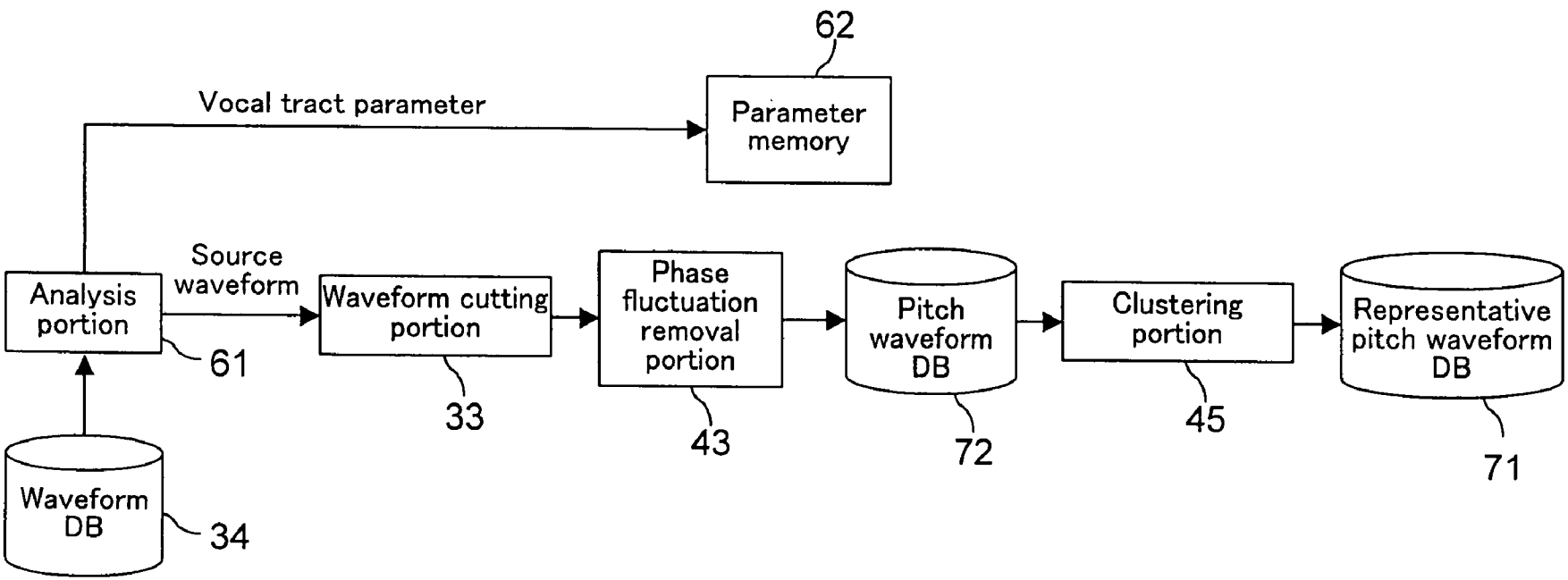
FIG. 24 is a block diagram showing a configuration of a device for producing representative pitch waveforms to be stored in a representative pitch waveform DB and vocal tract parameters to be stored in a parameter memory.

The interface in Embodiment 6 includes a speech synthesis section 70 shown in FIG. 23 in place of the speech synthesis section 30 shown in FIG. 1. The other components of the interface in Embodiment 6 are the same as those shown in FIG. 1. In a representative pitch waveform DB 71 shown in FIG. 23, stored in advance are representative pitch waveforms obtained from a device shown in FIG. 24 (device independent of the speech interaction interface). The configurations shown in FIGS. 23 and 24 include an analysis portion 61, a parameter memory 62 and a synthesis portion 63 in addition to the configurations shown in FIGS. 16 and 17(*a*). By configuring in this way, the data storage capacity can be reduced compared with Embodiment 5, and also degradation in sound quality due to prosodic deformation can be reduced compared with Embodiment 2.

Also, as another advantage of the above configuration, since a speech waveform is transformed to a source waveform by analyzing the speech waveform, that is, phonemic information is removed from the speech, the clustering efficiency is far superior to the case of using the speech waveform. That is, smaller data storage capacity and higher sound quality than those in Embodiment 2 are also expected from the standpoint of the cluster efficiency.

Embodiment 7

In Embodiment 3, the time length and amplitude of pitch waveforms were normalized to enhance the clustering efficiency, and in this way, the data storage capacity was reduced. This idea is also applicable to Embodiment 6.

Figure 25:
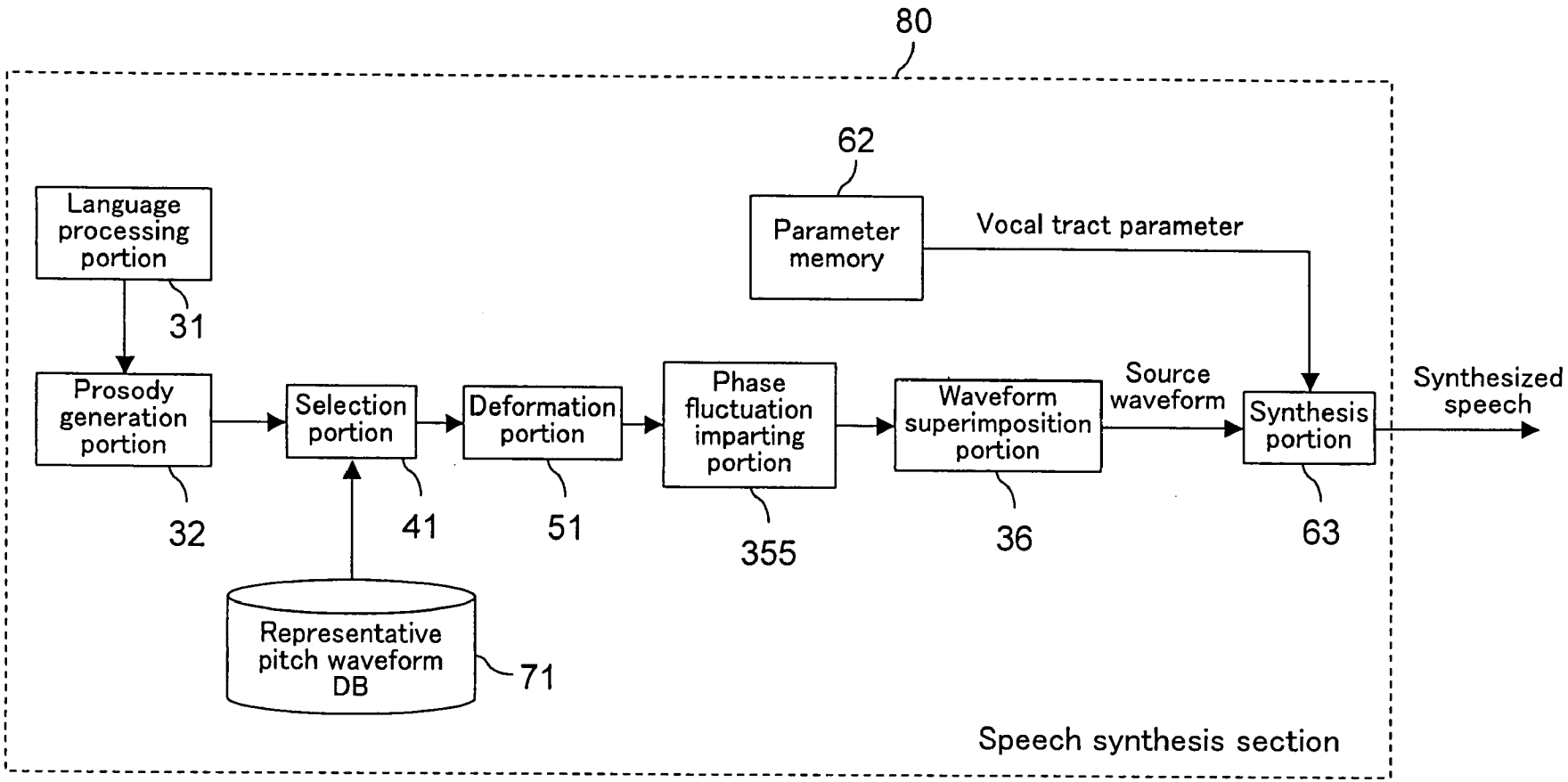
FIG. 25 is a block diagram showing a configuration of a speech synthesis section in Embodiment 7.
Figure 26:
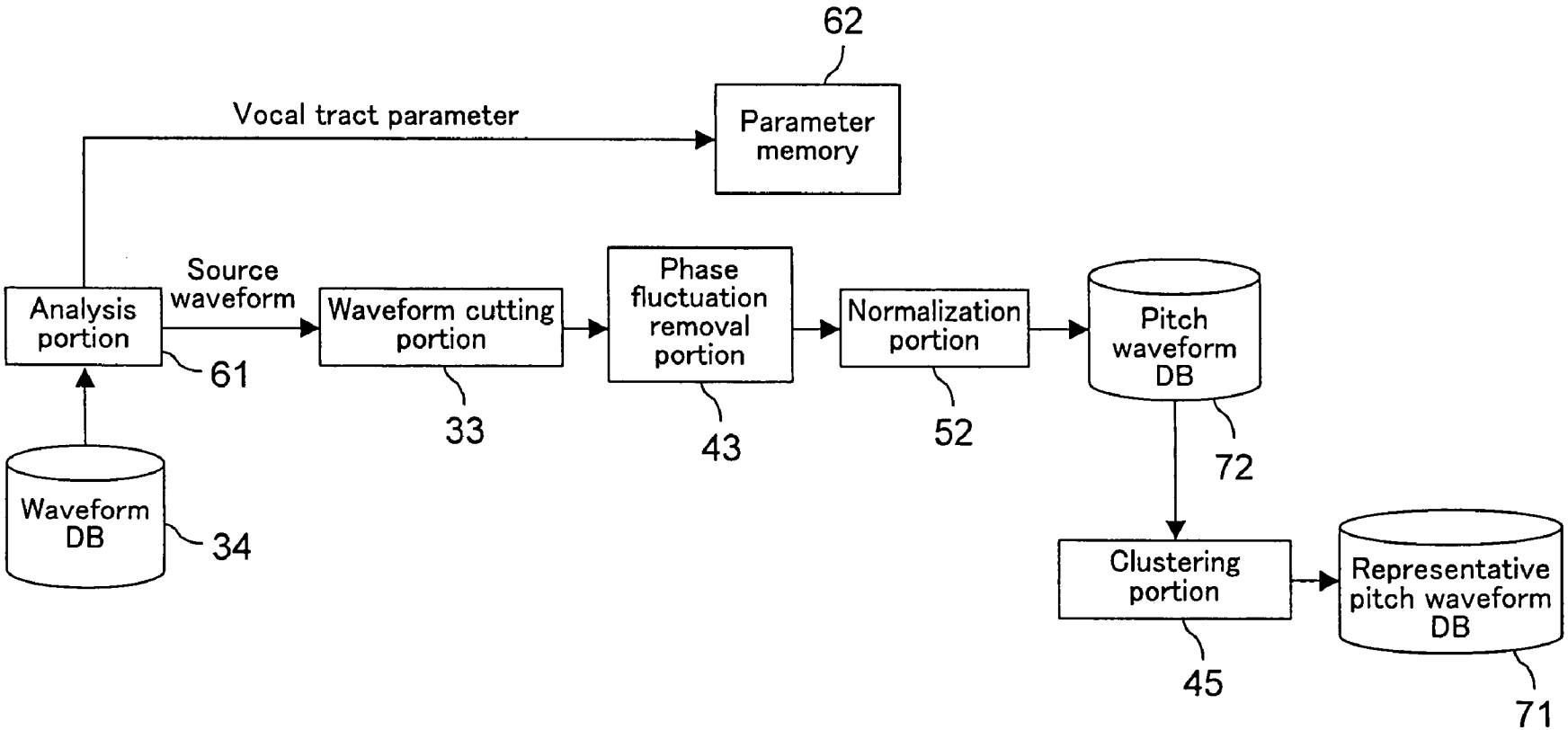
FIG. 26 is a block diagram showing a configuration of a device for producing representative pitch waveforms to be stored in a representative pitch waveform DB and vocal tract parameters to be stored in a parameter memory.
Figure 27:
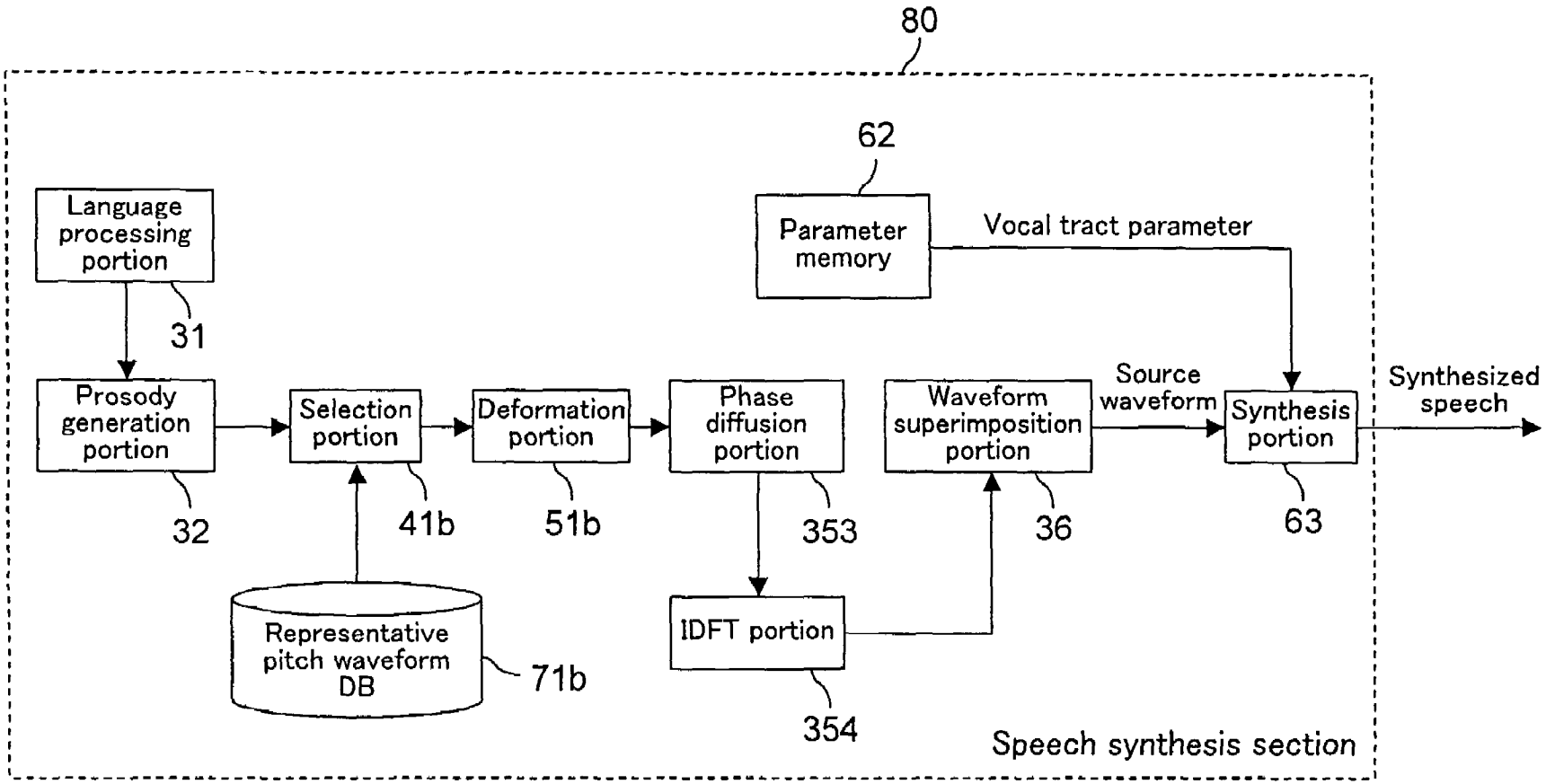
FIG. 27 is a block diagram showing a configuration of a speech synthesis section in Embodiment 8.

The interface in Embodiment 7 includes a speech synthesis section 80 shown in FIG. 25 in place of the speech synthesis section 30 shown in FIG. 1. The other components of the interface in Embodiment 7 are the same as those shown in FIG. 1. In a representative pitch waveform DB 71 shown in FIG. 25, stored in advance are representative pitch waveforms obtained from a device shown in FIG. 26 (device independent of the speech interaction interface). The configurations shown in FIGS. 25 and 26 include a normalization portion 52 and a deformation portion 51 in addition to the configurations shown in FIGS. 23 and 24. By configuring in this way, the clustering efficiency enhances compared with Embodiment 6, in which sound quality of a same level can be obtained with smaller data storage capacity, and synthesized speech with higher sound quality can be produced with the same storage capacity.

As in Embodiment 6, the clustering efficiency further enhances by removing phonemic information from speech, and thus higher sound quality or smaller storage capacity can be achieved.

Embodiment 8

In Embodiment 4, pitch waveforms were clustered in a frequency domain to enhance the clustering efficiency. This idea is also applicable to Embodiment 7.

Figure 28:
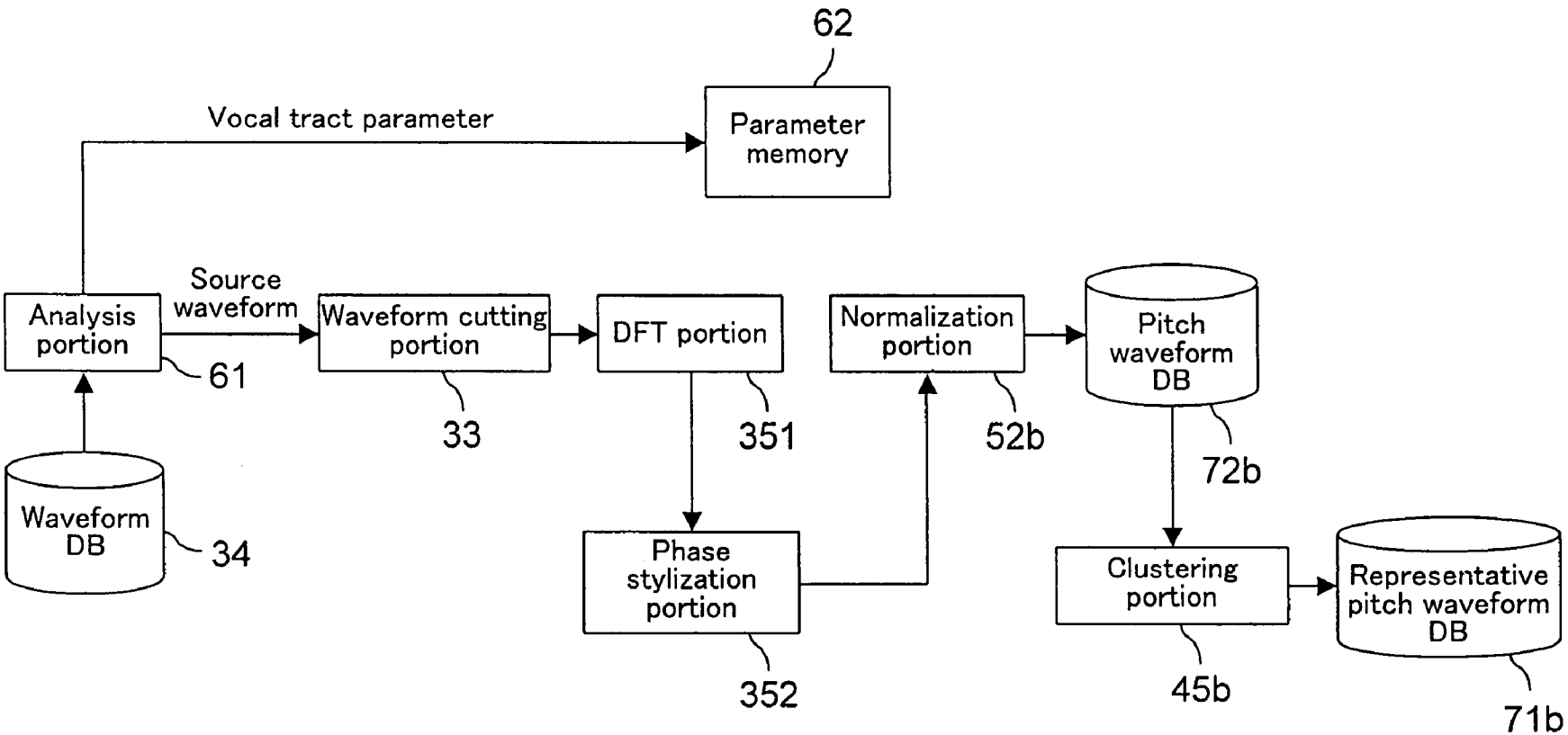
FIG. 28 is a block diagram showing a configuration of a device for producing representative pitch waveforms to be stored in a representative pitch waveform DB and vocal tract parameters to be stored in a parameter memory.
Figure 29A:
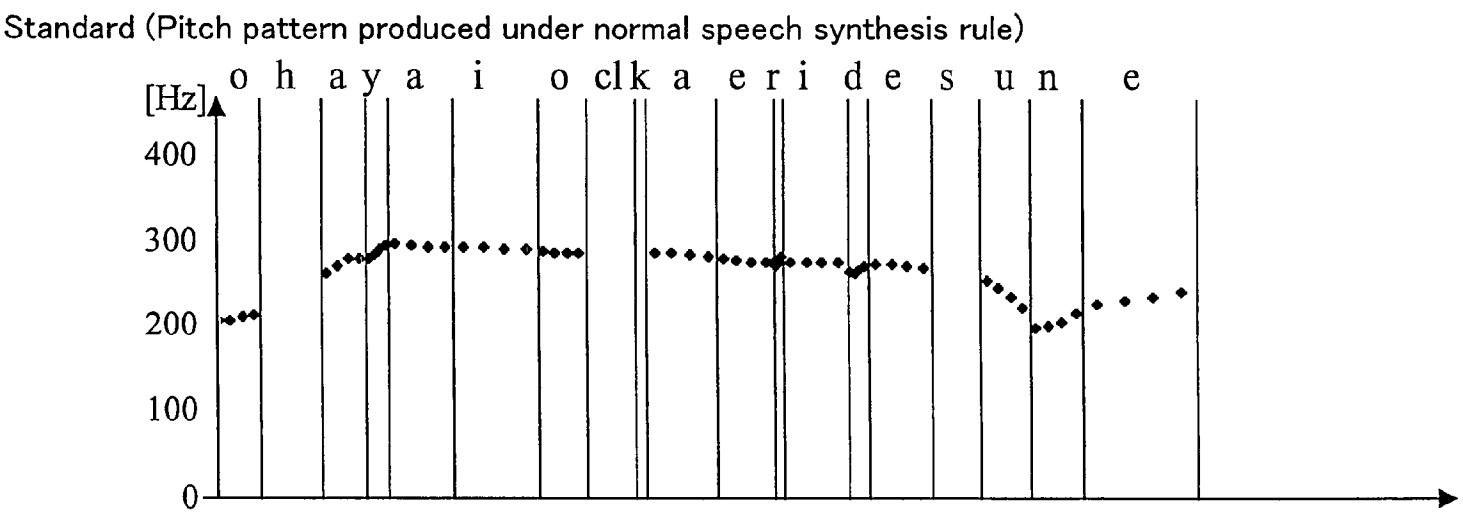
FIG. 29(*a*) is a view showing a pitch pattern produced under a normal speech synthesis rule.
Figure 29B:
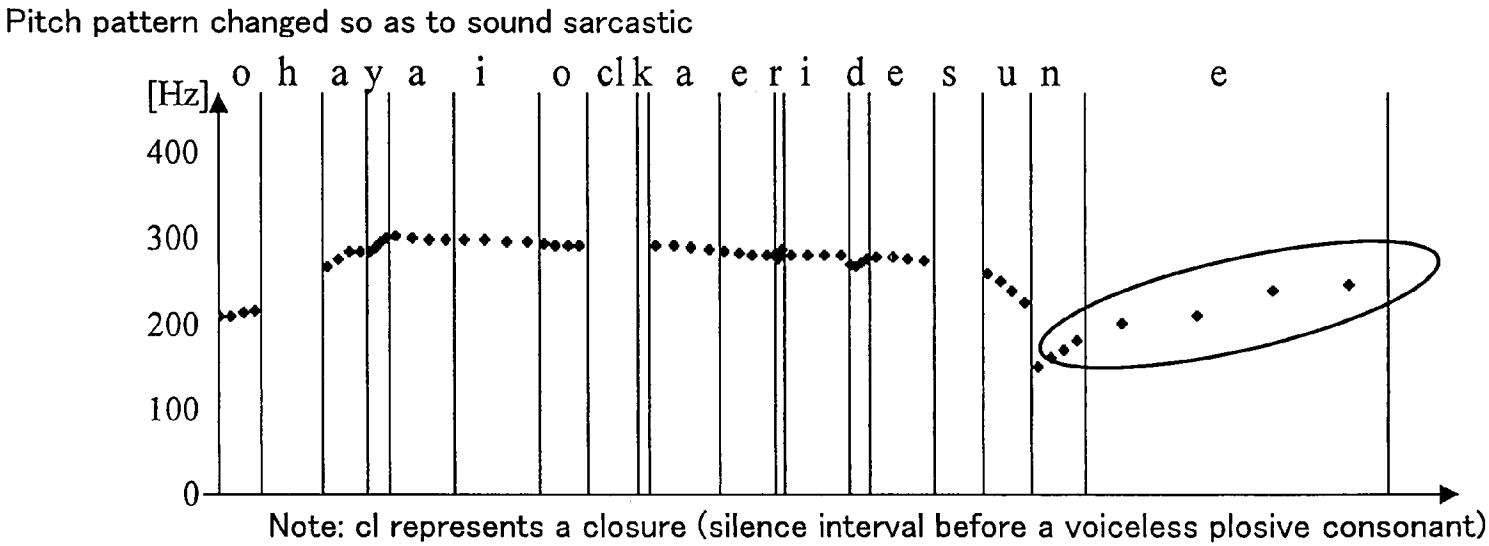

The interface in Embodiment 8 includes a phase diffusion portion 353 and an IDFT portion 354 in place of the phase fluctuation imparting portion 355 in FIG. 25. The representative pitch waveform DB 71, the selection portion 41 and the deformation portion 51 are respectively replaced with a representative pitch waveform DB 71*b*, a selection portion 41*b* and a deformation portion 51*b*. In the representative pitch waveform DB 71*b*, stored in advance are representative pitch waveforms obtained from a device shown in FIG. 28 (device independent of the speech interaction interface). The device shown in FIG. 28 includes a DFT portion 351 and a phase stylization portion 352 in place of the phase fluctuation removal portion 43 shown in FIG. 26. The normalization portion 52, the pitch waveform DB 72, the clustering portion 45 and the representative pitch waveform DB 71 are respectively replaced with a normalization portion 52*b*, a pitch waveform DB 72*b*, a clustering portion 45*b* and a representative pitch waveform DB 71*b*. As described in Embodiment 4, the components having the subscript b perform frequency-domain processing.

By configuring as described above, the following new effects can be provided in addition to the effects of Embodiment 7. That is, as described in Embodiment 4, in the frequency-domain clustering, the difference in the sensitivity of the auditory sense can be reflected on the distance calculation by performing frequency weighting, and thus the sound quality can be further enhanced. Also, since each one step of DFT and IDFT is omitted, the calculation cost is reduced, compared with Embodiment 7.

In Embodiments 1 to 8 described above, the method given with Expressions 1 to 7 and the method given with Expressions 8 and 9 were used for the phase diffusion. It is also possible to use other methods such as the method disclosed in Japanese Laid-Open Patent Publication No. 10-97287 and the method disclosed in the literature "An Improved Speech Analysis-Synthesis Algorithm based on the Autoregressive with Exogenous Input Speech Production Model" (Otsuka et al, ICSLP 2000).

Hanning window function was used in the waveform cutting portion 33. Alternatively, other window functions (such as Hamming window function and Blackman window function, for example) may be used.

DFT and IDFT were used for the mutual transformation of pitch waveforms between the frequency domain and the time domain. Alternatively, fast Fourier transform (FFT) and inverse fast Fourier transform (IFFT) may be used.

Linear interpolation was used for the time length deformation in the normalization portion 52 and the deformation portion 51. Alternatively, other methods (such as second-order interpolation and spline interpolation, for example) may be used.

The phase fluctuation removal portion 43 and the normalization portion 52 may be connected in reverse, and also the deformation portion 51 and the phase fluctuation imparting portion 355 may be connected in reverse.

In Embodiments 5 to 7, although the nature of the original speech to be analyzed was not especially referred to, the sound quality may degrade in various ways in each analyzing technique depending on the quality of the original speech. For example, in the ARX analysis synthesis system mentioned above, the analysis precision degrades when the speech to be analyzed has an intense whispering component, and this may results in production of non-smooth synthesized speech like "gero gero". However, the present inventors have found that generation of such sound decreases and smooth sound quality is obtained by applying the present invention. The reason has not been clarified, but it is considered that in speech having an intense whispering component, an analysis error may be concentrated on the source waveform, and as a result, a random phase component is excessively added to the source waveform. In other words, it is considered that by removing any phase fluctuation component from the source waveform according to the present invention, the analysis error can be effectively removed. Naturally, in such a case, the whispering component contained in the original speech can be reproduced by giving a random phase component again.

As for $\rho(k)$ in Expression 4, although the specific example was mainly described as using constant 0 for $\rho(k)$, $\rho(k)$ is not limited to constant 0, but may be any value as long as it is the same for all pitch waveforms. For example, a first order function, a second order function or any type of function of k may be used.

The invention claimed is:

1. A speech synthesis method comprising the steps of:

(a) removing only a phase fluctuation component from a speech waveform containing the phase fluctuation component by cutting a speech waveform in pitch period units using a predetermined window function, determining first DFT (discrete Fourier transform) of first pitch waveforms which are cut speech waveforms, and transforming the first DFT to second DFT by changing the phase of each frequency component of the first DFT to a value of a desired function having only the frequency as a variable or a constant value;

(b) imparting only a new phase fluctuation component in a high frequency region of the speech waveform obtained by removing the phase fluctuation component in the step (a); and (c) outputting synthesized speech through a speaker device using the speech waveform obtained by imparting the new phase fluctuation component in the step (b).

2. The speech synthesis method of claim 1, wherein in the step (b), the new phase fluctuation component is imparted at timing and/or weighting according to feelings to be expressed in the synthesized speech produced in the step (c).

3. The speech synthesis method of claim 1, wherein in the step (b), only the new phase fluctuation component is imparted by transforming the second DFT to third DFT by deforming the phase of a frequency component of the second DFT higher than a predetermined boundary frequency with a random number sequence; or only the new phase fluctuation component is imparted by:

transforming the second DFT to second pitch waveform by IDFT; and transforming the second pitch waveforms to third pitch waveforms by deforming the phase of a frequency component in a range higher than a predetermined boundary frequency with a random number sequence.

4. A speech synthesizer comprising:

(a) means of removing only a phase fluctuation component from a speech waveform containing the phase fluctuation component by cutting a speech waveform in pitch period units using a predetermined window function, determining first DFT (discrete Fourier transform) of first pitch waveforms which are cut speech waveforms, and transforming the first DFT to second DFT by changing the phase of each frequency component of the first DFT to a value of a desired function having only the frequency as a variable or a constant value;

(b) means of imparting only a new phase fluctuation component in a high frequency region of the speech waveform obtained by removing the phase fluctuation component by the means (a); and (c) means of outputting synthesized speech through a speaker device using the speech waveform obtained by imparting the new phase fluctuation component by the means (b).

5. The speech synthesizer of claim 4, further comprising:

(d) means of controlling timing and/or weighting at which the new phase fluctuation component is imparted.

6. A speech synthesis method comprising the steps of:

(a) removing only a phase fluctuation component from a speech waveform containing the phase fluctuation component by analyzing the speech waveform with a vocal tract model and a glottal source model;

estimating a glottal source waveform by removing a vocal tract characteristic obtained by the analysis from the speech waveform;

cutting the glottal source waveform in pitch period units using a predetermined window function;

determining first DFT of first pitch waveforms as cut glottal source waveforms, and transforming the first DFT to second DFT by changing the phase of each frequency component of the first DFT to a value of a desired function having only the frequency as a variable or a constant value;

(b) imparting only a new phase fluctuation component in a high frequency region of the speech waveform obtained by removing the phase fluctuation component in the step (a) and (c) outputting synthesized speech through a speaker device using the speech waveform obtained by imparting the new phase fluctuation component in the step (b).

7. The speech synthesis method of claim 6, wherein in the step (b), only the new phase fluctuation component is imparted by transforming the second DFT to third DFT by deforming the phase of a frequency component of the second DFT higher than a predetermined boundary frequency with a random number sequence; or only the new phase fluctuation component is imparted by:

transforming the second DFT to second pitch waveforms by IDFT; and transforming the second pitch waveforms to third pitch waveforms by deforming the phase of a frequency component in a range higher than a predetermined boundary frequency with a random number sequence.

8. The speech synthesis method of claim 6, wherein in the step (b), the new phase fluctuation component is imparted at timing and/or weighting according to feeling to be expressed in the synthesized speech produced in the step (c).

9. A speech synthesizer comprising:

(a) means of removing only a phase fluctuation component from a speech waveform containing the phase fluctuation component by analyzing the speech waveform with a vocal tract model and a glottal source model;

estimating a glottal source waveform by removing a vocal tract characteristic obtained by the analysis from the speech waveform;

cutting the glottal source waveform in pitch period units using a predetermined window function;

determining first DFT of first pitch waveforms as cut glottal source waveforms; and transforming the first DFT to second DFT by changing the phase of each frequency component of the first DFT to a value of a desired function having only the frequency as a variable or a constant value;

(b) means of imparting only a new phase fluctuation component in a high frequency region of the speech waveform obtained by removing the phase fluctuation component by the means (a); and (c) means of outputting synthesized speech through a speaker device using the speech waveform obtained by imparting the new phase fluctuation component by the means (b).

10. The speech synthesizer of claim 9, further comprising:

(a) means of controlling timing and/or weighting at which the new phase fluctuation component is imparted.

* * * * *

UNITED STATES PATENT AND TRADEMARK OFFICE

CERTIFICATE OF CORRECTION

PATENT NO. : 7,562,018 B2
APPLICATION NO. : 10/506203
DATED : July 14, 2009
INVENTOR(S) : Kamai et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 868 days.

Signed and Sealed this
Thirty-first Day of May, 2011

David J. Kappos

David J. Kappos
*Director of the United States Patent and Trademark Office*